US010146146B2

(12) United States Patent
Komatsu et al.

(10) Patent No.: US 10,146,146 B2
(45) Date of Patent: Dec. 4, 2018

(54) TONER AND METHOD OF PRODUCING TONER

(71) Applicant: CANON KABUSHIKI KAISHA, Tokyo (JP)

(72) Inventors: Nozomu Komatsu, Toride (JP); Takeshi Hashimoto, Moriya (JP); Masayuki Hama, Toride (JP); Takakuni Kobori, Toride (JP); Ichiro Kanno, Kashiwa (JP); Yuto Onozaki, Saitama (JP); Hitoshi Sano, Tokyo (JP); Akifumi Matsubara, Narashino (JP); Hiroyuki Fujikawa, Yokohama (JP); Tsubasa Fujisaki, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/495,196

(22) Filed: Apr. 24, 2017

(65) Prior Publication Data

US 2017/0315461 A1 Nov. 2, 2017

(30) Foreign Application Priority Data

Apr. 28, 2016 (JP) ..... 2016-090033

(51) Int. Cl.

*G03G 9/097* (2006.01)
*G03G 9/087* (2006.01)
*G03G 9/08* (2006.01)
*G03G 9/09* (2006.01)

(52) U.S. Cl.

CPC ..... *G03G 9/08755* (2013.01); *G03G 9/081* (2013.01); *G03G 9/0804* (2013.01); *G03G 9/0819* (2013.01); *G03G 9/0825* (2013.01); *G03G 9/08795* (2013.01); *G03G 9/08797* (2013.01); *G03G 9/0918* (2013.01); *G03G 9/09708* (2013.01); *G03G 9/09716* (2013.01); *G03G 9/09725* (2013.01)

(58) Field of Classification Search

CPC ..... G03G 9/08755; G03G 9/09725
See application file for complete search history.

(56) References Cited

U.S. PATENT DOCUMENTS 5,424,810 A 6/1995 Tomiyama et al.
5,464,722 A 11/1995 Tomiyama et al.
5,700,616 A 12/1997 Kasuya et al.
5,712,073 A 1/1998 Katada et al.
5,968,701 A 10/1999 Onuma et al.
5,972,553 A 10/1999 Katada et al.
6,002,895 A 12/1999 Kasuya et al.
6,007,957 A 12/1999 Kobori et al.
6,020,102 A 2/2000 Fujimoto et al.
6,120,961 A 9/2000 Tanikawa et al.
6,156,471 A 12/2000 Kobori et al.
6,203,959 B1 3/2001 Tanikawa et al.
6,235,441 B1 5/2001 Tanikawa et al.
6,430,384 B2 8/2002 Hama et al.
6,653,036 B1 11/2003 Tanikawa et al.
6,670,087 B2 12/2003 Fujikawa et al.
6,751,424 B2 6/2004 Komatsu et al.
6,808,852 B2 10/2004 Hotta et al.
7,112,395 B2 9/2006 Ida et al.
7,135,263 B2 11/2006 Kawakami et al.
7,147,980 B2 12/2006 Itakura et al.
7,147,981 B2 12/2006 Fujikawa et al.
7,229,727 B2 6/2007 Itakura et al.
7,279,262 B2 10/2007 Fujikawa et al.
7,288,348 B2 10/2007 Hayami et al.
7,297,455 B2 11/2007 Fujikawa et al.
7,300,733 B2 11/2007 Sugahara et al.
7,396,626 B2 7/2008 Fujikawa et al.
7,396,629 B2 7/2008 Baba et al.
7,442,478 B2 10/2008 Itakura et al.
7,452,647 B2 11/2008 Hayami
7,611,813 B2 11/2009 Ida et al.
7,855,042 B2 12/2010 Kobori et al.
7,858,283 B2 12/2010 Ishigami et al.
7,927,775 B2 4/2011 Komatsu et al.
7,939,233 B2 5/2011 Inoue et al.
8,137,886 B2 3/2012 Baba et al.
8,142,972 B2 3/2012 Hotta et al.
8,288,069 B2 10/2012 Fujikawa et al.
8,927,188 B2 1/2015 Naka et al.
8,986,914 B2 3/2015 Fujikawa et al.
9,034,549 B2 5/2015 Shiotari et al.
9,058,924 B2 6/2015 Komatsu et al.
9,063,443 B2 6/2015 Ishigami et al.
9,152,088 B1 10/2015 Kobori et al.
9,348,253 B2 5/2016 Kanno et al.
9,372,420 B2 6/2016 Mizo et al.
9,417,540 B2 8/2016 Hashimoto et al.
9,500,975 B2 11/2016 Sugahara et al.
9,594,323 B2 3/2017 Fujikawa et al.
9,599,920 B2 3/2017 Sugahara et al.
9,665,021 B2 5/2017 Ohtsu et al.
9,665,023 B2 5/2017 Kamae et al.
(Continued)

FOREIGN PATENT DOCUMENTS

JP 2004-309517 A 11/2004
JP 2007-033773 * 2/2007 ..... G03G 9/087
JP 2010-026185 A 2/2010

OTHER PUBLICATIONS

Translation of JP 2007-033773 published Feb. 2007.*
U.S. Appl. No. 15/498,966, Yuto Onozaki, filed Apr. 27, 2017.

*Primary Examiner* — Peter L Vajda
(74) *Attorney, Agent, or Firm* — Fitzpatrick Cella Harper and Scinto

(57) ABSTRACT

A toner comprising a toner particle containing a binder resin, a wax, and inorganic fine particles, wherein the binder resin contains a crystalline polyester resin and an amorphous polyester resin, and, in a cross section of the toner particle, when Sc represents an area taken up by the crystalline polyester resin and S1 represents an area taken up by the inorganic fine particles that are present in the crystalline polyester resin portion, Sc and S1 satisfy the relationship $S1/Sc \geq 0.2$.

7 Claims, No Drawings

(56) References Cited

U.S. PATENT DOCUMENTS

| | | | | |
|---|---|---|---|---|
| 9,665,026 | B2 | 5/2017 | Iwasaki et al. | |
| 2009/0197190 | A1 | 8/2009 | Nakamura et al. | |
| 2010/0028796 | A1 | 2/2010 | Nakamura et al. | |
| 2010/0183971 | A1 | 7/2010 | Fujikawa et al. | |
| 2013/0244159 | A1 | 9/2013 | Ishigami et al. | |
| 2013/0288173 | A1 | 10/2013 | Hashimoto et al. | |
| 2014/0045115 | A1 | 2/2014 | Baba et al. | |
| 2014/0101966 | A1 | 4/2014 | Minagawa et al. | |
| 2014/0134535 | A1 | 5/2014 | Baba et al. | |
| 2014/0137428 | A1 | 5/2014 | Takenaka et al. | |
| 2014/0329176 | A1 | 11/2014 | Kanno et al. | |
| 2015/0168861 | A1* | 6/2015 | Farrugia ..... | G03G 9/10<br>430/108.15 |
| 2016/0306301 | A1 | 10/2016 | Sugahara et al. | |
| 2016/0363877 | A1 | 12/2016 | Hama et al. | |
| 2016/0363878 | A1 | 12/2016 | Hama et al. | |
| 2016/0363889 | A1 | 12/2016 | Onozaki et al. | |

* cited by examiner

TONER AND METHOD OF PRODUCING TONER

BACKGROUND OF THE INVENTION

Field of the Invention

The present invention relates to a toner used in electrophotographic systems, electrostatic recording systems, electrostatic printing systems, and toner jet systems. The present invention further relates to a method of producing toner.

Description of the Related Art

There is strong demand that electrophotographic-based image-forming apparatuses exhibit, for example, lower power consumptions and shorter wait times even from current levels. Low-temperature fixability is being required of the toner in order to respond to this demand. Moreover, in order to consistently output high-quality images on a long-term basis even in various use environments, the toner charging performance must be resistant to influences from temperature and humidity and variations in the amount of toner charge must be minimized.

With the goal of achieving low-temperature fixability, polyester resins having an excellent sharp melt property have been used as the binder resin. Moreover, in recent years, the use of crystalline polyester resins and not just amorphous polyester resins has been frequently proposed. In Japanese Patent Application Laid-open No. 2010-26185, the crystallization of a crystalline polyester is promoted and improvements in the storage stability and low-temperature fixability are made through the internal addition of silica particles carrying a fatty acid amide on the surface. Japanese Patent Application Laid-open No. 2004-309517 proposes the efficient production of a toner having an excellent low-temperature fixability through the use of a crystalline resin provided by the condensation polymerization of starting monomer to which inorganic fine particles have been added.

SUMMARY OF THE INVENTION

However, crystalline polyesters have a lower resistance than amorphous polyesters. Due to this, the charge retention performance readily declines in the case of the toners proposed in the literature indicated above. In particular, a decline in charge readily occurs in a high-temperature, high-humidity environment (also indicated in the following as an H/H environment) and large changes in the image density can then occur.

Thus, even systems that use a crystalline resin have not been able to provide a toner that can simultaneously satisfy the fixing performance and charge stability.

An object of the present invention is to solve this problem. That is, an object of the present invention is to provide a toner that, even being a toner that uses a crystalline material, exhibits an excellent charge stability in high-temperature, high-humidity environments and an excellent fixing performance. An additional object of the present invention is to provide a method of producing this toner.

The aforementioned problem can be solved by a toner having the following constitution.

That is, the present invention relates to a toner that comprises a toner particle containing a binder resin, a wax, and inorganic fine particles, wherein the binder resin contains a crystalline polyester resin and an amorphous polyester resin, and, in a cross section of the toner particle, when Sc represents an area taken up by the crystalline polyester resin and S1 represents an area taken up by the inorganic fine particles that are present in the crystalline polyester resin portion, Sc and S1 satisfy the relationship $S1/Sc \geq 0.2$.

The present invention can thereby provide a toner that exhibits an excellent charge stability in high-temperature, high-humidity environments and an excellent fixing performance.

Further features of the present invention will become apparent from the following description of exemplary embodiments.

DESCRIPTION OF THE EMBODIMENTS

Unless specifically indicated otherwise, expressions such as "at least XX and not more than YY" and "XX to YY" that show numerical value ranges refer in the present invention to numerical value ranges that include the lower limit and upper limit that are the end points.

Embodiments of the present invention are described in detail in the following.

The toner of the present invention is a toner that comprises a toner particle containing a binder resin, a wax, and inorganic fine particles, wherein the binder resin comprises a crystalline polyester resin and an amorphous polyester resin, and, in a cross section of the toner particle, when Sc represents an area taken up by the crystalline polyester resin and S1 represents an area taken up by the inorganic fine particles that are present in the crystalline polyester resin portion, Sc and S1 satisfy the relationship $S1/Sc \geq 0.2$.

The crystalline polyester resin in the present invention is a resin for which an endothermic peak is observed in a differential scanning calorimetric (DSC) measurement.

This toner exhibits an excellent fixability and the charging performance of this toner is resistant to the influence of even high-temperature, high-humidity environments. Moreover, a high-quality image can be consistently output because there is little change in the amount of toner charge.

The reason that a solution to the aforementioned problem is reached in the present invention is not necessarily clear, but the thinking as follows.

The addition of a crystalline polyester resin having a plasticizing effect on the amorphous polyester resin is effective for improving the fixing performance. However, since crystalline polyesters generally have a lower resistance than amorphous polyesters, depending on the state of occurrence of the crystalline polyester in the toner particle the resistance of the toner declines and the toner charge readily becomes unstable.

Thus, attempts have been made to improve the toner charge stability by raising the resistance for the toner by incorporating, in a crystalline polyester resin-containing toner particle, inorganic fine particles having a higher resistance than the crystalline polyester resin. However, it was found that just a simple dispersion/incorporation of high-resistance inorganic fine particles in the toner particle provides an inadequate charge-stabilizing effect. Moreover, when the incorporated inorganic fine particles were brought to high concentrations, it was also found that, for a toner that also contained an amorphous polyester fraction, the viscosity of the toner as a whole could be increased due to the filler effect and the fixing performance of the toner could be reduced.

As a result of intensive investigations, the present inventors then discovered that an excellent charge stability is obtained by bringing about the presence of inorganic fine particles in at least a certain ratio in the crystalline polyester resin fraction in the toner particle. The reason for this is hypothesized to be as follows: when inorganic fine particles are present in at least a certain ratio in the crystalline polyester resin fraction, the crystalline structure of the crystalline polyester resin is slightly disturbed and due to this the microresistance is increased. In addition, since the inorganic fine particles are present acting as nuclei for the crystalline polyester resin fraction, which generally has a low softening point, the toner durability is improved and an excellent charge stability can be maintained even during long-term use.

Moreover, it was determined that there is little influence on the fixing performance of the toner even when the inorganic fine particles are present in a high concentration in the crystalline polyester resin fraction in the present invention. For this reason, it is important that the fine particles used in the toner of the present invention be inorganic fine particles. Inorganic fine particles are present in a state in which the primary particles are aggregated to an appropriate degree, thereby forming a spatial expanse. The crystalline polyester resin can infiltrate into the spaces formed by these inorganic fine particles. It is hypothesized that as a result the crystalline structure of the crystalline polyester resin is slightly disturbed and the microresistance becomes high, as noted above, while at the same time the sharp melt property is also not impaired and as a consequence there is little influence on the fixing performance.

It is for these reasons that, even in the case of a toner that uses a crystalline material, a toner could be obtained that exhibited an excellent charge stability in high-temperature, high-humidity environments and an excellent fixing performance.

In the toner according to the present invention, the relationship between Sc and S1 in the toner particle cross section—where Sc is the area taken up by the crystalline polyester resin and S1 is the area taken up by the inorganic fine particles that are present in the crystalline polyester resin portion—is $S1/Sc \geq 0.2$ and preferably $S1/Sc \geq 0.3$. When S1/Sc is in the indicated range, the toner exhibits an excellent charge retention and in particular charge relaxation after holding in an H/H environment is suppressed. These effects are not obtained to a satisfactory degree when S1/Sc is less than 0.2. The upper limit on S1/Sc is not particularly limited, but is preferably not more than 0.9 and is more preferably not more than 0.7. S1/Sc can be controlled, for example, through the conditions during production, infra, the amount of addition for the crystalline polyester resin, and the amount of addition for the inorganic fine particles.

In the toner according to the present invention, the relationship between St and Sc in the toner particle cross section—where St is the cross-sectional area of the toner particle and Sc is the area taken up by the crystalline polyester resin—is also preferably $0.01 \leq Sc/St \leq 0.40$, more preferably $0.01 \leq Sc/St \leq 0.25$, and even more preferably $0.02 \leq Sc/St \leq 0.15$. When the Sc/St relationship is in the indicated range, an even better fixing performance is obtained while the generation of fogging due to charge relaxation is suppressed.

In the toner according to the present invention, the relationship between S2 and S1 in the toner particle cross section—where S2 is the total area taken up by the inorganic fine particles and S1 is the area taken up by the inorganic fine particles that are present in the crystalline polyester resin portion—is preferably $S1/S2 \geq 0.6$, more preferably $S1/S2 \geq 0.7$, and even more preferably $S1/S2 \geq 0.8$. When the S1/S2 relationship is in the indicated range, the inorganic fine particles present in the crystalline polyester resin portion are then present in higher concentrations and due to this an even better charge stability is obtained. As a result, little variation occurs in image density even during long-term use in an H/H environment. The upper limit on S1/S2 is not particularly limited but is preferably equal to or less than 1.0. S1/S2 can be controlled through, for example, the conditions during production, infra, the amount of addition of the crystalline polyester, and the amount of addition of the inorganic fine particles.

The constitutions of preferred toners for the present invention are described in the following. The binder resin in the present invention contains a crystalline polyester resin and an amorphous polyester resin. Other resins may be incorporated to the degree that the effects of the present invention are not impaired. More preferably, the binder resin is a crystalline polyester resin and an amorphous polyester resin.

[Amorphous Polyester Resin]

The amorphous polyester resin used in the toner of the present invention is preferably a condensation-polymerized resin from a carboxylic acid component and an alcohol component having aromatic diol as its main component. In the present invention, "main component" indicates a content thereof of at least 50 mass %.

There are no particular limitations on the aromatic diol used in the amorphous polyester resin, but bisphenol derivatives given by the following formula (A) and diols given by the following formula (B) are preferred.

(A)

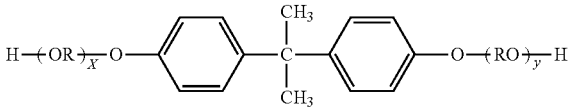

[In the formula, R is an ethylene or propylene group; x and y are each integers equal to or greater than 1; and the average value of x+y is 2 to 7.]

(B)

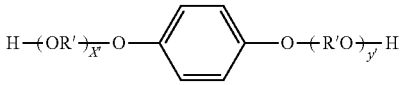

[In the formula, R' is

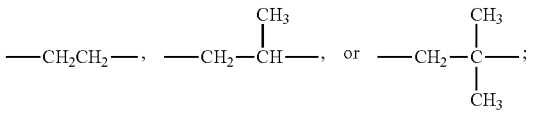

x' and y' are each integers equal to or greater than 0; and the average value of x'+y' is 0 to 10.]

The bisphenol derivatives given by formula (A) can be exemplified by polyoxypropylene(2.2)-2,2-bis(4-hydroxyphenyl)propane, polyoxypropylene(3.3)-2,2-bis(4-hydroxyphenyl)propane, polyoxyethylene(2.0)-2,2-bis(4-hydroxyphenyl)propane, polyoxypropylene(2.0)-polyoxyethylene(2.0)-2,2-bis(4-hydroxyphenyl)propane, and polyoxypropylene(6)-2,2-bis(4-hydroxyphenyl)propane.

Depending on the particular case, another diol—e.g., bisphenol A or hydrogenated bisphenol A or a diol such as ethylene glycol, diethylene glycol, triethylene glycol, 1,2-propanediol, 1,3-propanediol, 1,4-butanediol, neopentyl glycol, 1,4-butenediol, 1,5-pentanediol, 1,6-hexanediol, and so forth—may also be used in combination with the bisphenol derivative given by formula (A) or the diol given by formula (B).

Other alcohol components that can be used in the amorphous polyester resin can be exemplified by ethylene glycol, diethylene glycol, triethylene glycol, 1,2-propanediol, 1,3-propanediol, 1,4-butanediol, neopentyl glycol, 1,4-butenediol, 1,5-pentanediol, 1,6-hexanediol, 1,4-cyclohexanedimethanol, dipropylene glycol, polyethylene glycol, polypropylene glycol, polytetramethylene glycol, sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxymethylbenzene.

As indicated above, aromatic diol is the main component of the alcohol component constituting the amorphous polyester resin. Here, the alcohol component constituting the amorphous polyester resin preferably contains aromatic diol in a proportion of at least 80 mol % and not more than 100 mol % and more preferably contains aromatic diol in a proportion of at least 90 mol % and not more than 100 mol %.

The following polybasic carboxylic acid monomers can be used as the polybasic carboxylic acid monomer used in the polyester unit of the polyester resin.

The dibasic carboxylic acid component can be exemplified by maleic acid, fumaric acid, citraconic acid, itaconic acid, glutaconic acid, phthalic acid, isophthalic acid, terephthalic acid, succinic acid, adipic acid, sebacic acid, azelaic acid, malonic acid, n-dodecenylsuccinic acid, isododecenylsuccinic acid, n-dodecylsuccinic acid, isododecylsuccinic acid, n-octenylsuccinic acid, n-octylsuccinic acid, isooctenylsuccinic acid, isooctylsuccinic acid, and the anhydrides and lower alkyl esters of these acids. The use is preferred among the preceding of maleic acid, fumaric acid, terephthalic acid, and n-dodecenylsuccinic acid.

The at least tribasic carboxylic acids, their anhydrides, and their lower alkyl esters can be exemplified by 1,2,4-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxyl-2-methyl-2-methylenecarboxypropane, 1,2,4-cyclohexanetricarboxylic acid, tetra(methylenecarboxyl)methane, 1,2,7,8-octanetetracarboxylic acid, pyromellitic acid, Empol trimer acid, and the anhydrides and lower alkyl esters of the preceding. Among the preceding, the use of 1,2,4-benzenetricarboxylic acid, i.e., trimellitic acid, or a derivative thereof is preferred in particular because it is inexpensive and supports facile control of the reaction. A single one of these dibasic carboxylic acids may be used by itself or a combination of a plurality may be used, and a single one of the at least tribasic carboxylic acids may be used by itself or a combination of a plurality may be used.

The amorphous polyester resin may be a hybrid resin that, as long as polyester resin is its main component, contains another resin component. An example here is a hybrid resin of a polyester resin and a vinyl resin. In a preferred method for obtaining such a hybrid resin in the form of a reaction product between a polyester resin and a vinyl resin or vinyl copolymer unit, a polymerization reaction for either resin or both resins is carried out in the presence of a polymer that contains a monomer component that can react with each of the polyester resin and the vinyl resin or vinyl copolymer unit.

With regard to the monomer constituting the polyester resin component, monomer that can react with a vinyl copolymer can be exemplified by unsaturated dicarboxylic acids such as phthalic acid, maleic acid, citraconic acid, and itaconic acid, or the anhydrides of the preceding. With regard to the monomer constituting the vinyl copolymer component, monomer that can react with the polyester resin component can be exemplified by monomer that contains a carboxyl group or hydroxy group and by acrylate esters and methacrylate esters.

Besides the preceding vinyl resins, various resin compounds heretofore known as binder resins can be co-used in the amorphous polyester resin in the present invention as long as polyester resin is the main component. These resin compounds can be exemplified by phenolic resins, natural resin-modified phenolic resins, natural resin-modified maleic resins, acrylic resins, methacrylic resins, polyvinyl acetate resins, silicone resins, polyester resins, polyurethane, polyamide resins, furan resins, epoxy resins, xylene resins, polyvinyl butyral, terpene resins, coumarone-indene resins, and petroleum resins.

The amorphous polyester in the present invention can be produced according to common methods for polyester synthesis. For example, a desired polyester resin can be obtained by running an esterification reaction or transesterification reaction between the aforementioned carboxylic acid component and alcohol component and then running a polycondensation reaction according to the usual methods under reduced pressure or with the introduction of nitrogen gas.

The esterification or transesterification reaction can be carried out as necessary using an ordinary esterification catalyst or transesterification catalyst, e.g., sulfuric acid, titanium butoxide, dibutyltin oxide, manganese acetate, magnesium acetate, and so forth.

The aforementioned polycondensation reaction can be run using a known catalyst, for example, a common polymerization catalyst such as titanium butoxide, dibutyltin oxide, tin acetate, zinc acetate, tin disulfide, antimony trioxide, germanium dioxide, and so forth.

The peak molecular weight of the amorphous polyester resin is preferably at least 8,000 and not more than 13,000 from the standpoint of the low-temperature fixability and the hot offset resistance. In addition, the acid value of the amorphous polyester resin is preferably at least 15 mg KOH/g and not more than 30 mg KOH/g from the standpoint of the charge stability in high-temperature, high-humidity environments. The hydroxyl value of the amorphous polyester resin is preferably at least 2 mg KOH/g and not more than 20 mg KOH/g from the standpoint of the low-temperature fixability and the storability.

A mixture of a high molecular weight amorphous polyester resin (H) and a low molecular weight amorphous polyester resin (L) may also be used for the amorphous polyester resin. Considered from the standpoint of the low-temperature fixability and hot offset resistance, the content ratio (H/L) between the high molecular weight amorphous polyester resin (H) and the amorphous polyester resin (L) is preferably 10/90 to 60/40 on a mass basis.

The peak molecular weight of the high molecular weight amorphous polyester resin (H) is preferably at least 10,000 and not more than 20,000 from the standpoint of the hot offset resistance. In addition, the acid value of the high molecular weight amorphous polyester resin (H) is preferably at least 15 mg KOH/g and not more than 30 mg KOH/g from the standpoint of the charge stability in high-temperature, high-humidity environments.

The weight-average molecular weight of the low molecular weight amorphous polyester resin (L) is preferably at least 2,000 and not more than 6,000 from the standpoint of the low-temperature fixability. In addition, the acid value of the low molecular weight amorphous polyester resin (L) is preferably not more than 10 mg KOH/g from the standpoint of the charge stability in high-temperature, high-humidity environments.

[Crystalline Polyester Resin]

The crystalline polyester resin can be obtained in the present invention from an alcohol component and a carboxylic acid component. A preferred crystalline polyester resin is a condensation-polymerized resin from an alcohol component containing at least 80 mol % and not more than 100 mol % aliphatic diol having at least 6 and not more than 12 carbons and a carboxylic acid component containing at least 80 mol % and not more than 100 mol % aliphatic dicarboxylic acid having at least 6 and not more than 12 carbons. More preferably, the alcohol component contains at least 85 mol % and not more than 100 mol % aliphatic diol and the carboxylic acid component contains at least 85 mol % and not more than 100 mol % aliphatic dicarboxylic acid.

There are no particular limitations on the aliphatic diol, but a chain (more preferably a linear) aliphatic diol is preferred, and preferred examples thereof are butanediol, pentanediol, hexanediol, heptanediol, octanediol, nonanediol, and decanediol.

A polyhydric alcohol component other than the aforementioned aliphatic diol can also be used in combination therewith for the alcohol component for the crystalline polyester resin. Among polyhydric alcohol components, the dihydric alcohols can be exemplified by 1,4-cyclohexanedimethanol and by aromatic alcohols such as polyoxyethylenated bisphenol A and polyoxypropylenated bisphenol A.

Among polyhydric alcohol monomers, the at least trihydric polyhydric alcohols can be exemplified by aromatic alcohols such as 1,3,5-trihydroxymethylbenzene and by aliphatic alcohols such as pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, and trimethylolpropane.

A monohydric alcohol may be used in combination for the alcohol component for the crystalline polyester resin in the present invention. This monohydric alcohol can be exemplified by monofunctional alcohols such as n-butanol, isobutanol, sec-butanol, n-hexanol, n-octanol, lauryl alcohol, 2-ethylhexanol, decanol, cyclohexanol, benzyl alcohol, and dodecyl alcohol.

On the other hand, there are no particular limitations on the aliphatic dicarboxylic acid, but a chain (more preferably a linear) aliphatic dicarboxylic acid is preferred. Specific examples here are oxalic acid, malonic acid, succinic acid, glutaric acid, adipic acid, pimelic acid, suberic acid, glutaconic acid, azelaic acid, and sebacic acid; also included here are, for example, those provided by the hydrolysis of the anhydrides or lower alkyl esters of the preceding.

A polybasic carboxylic acid other than an aliphatic dicarboxylic acid can also be used in combination therewith as the carboxylic acid component for the crystalline polyester resin. Among such additional polybasic carboxylic acids, the dibasic carboxylic acids can be exemplified by aromatic carboxylic acids such as isophthalic acid and terephthalic acid; aliphatic carboxylic acids such as n-dodecylsuccinic acid and n-dodecenylsuccinic acid; and alicyclic carboxylic acids such as cyclohexanedicarboxylic acid, and, for example, the anhydrides and lower alkyl esters of the preceding are also included here. With regard to other carboxylic acids, the at least tribasic polybasic carboxylic acids can be exemplified by aromatic carboxylic acids such as 1,2,4-benzenetricarboxylic acid (trimellitic acid), 2,5,7-naphthalenetricarboxylic acid, 1,2,4-naphthalenetricarboxylic acid, and pyromellitic acid and by aliphatic carboxylic acids such as 1,2,4-butanetricarboxylic acid, 1,2,5-hexanetricarboxylic acid, and 1,3-dicarboxyl-2-methyl-2-methylenecarboxypropane; derivatives such as the anhydrides and lower alkyl esters of the preceding are also included.

A monobasic carboxylic acid may also be included in the carboxylic acid component for the crystalline polyester resin. The monobasic carboxylic acid can be exemplified by monocarboxylic acids such as benzoic acid, naphthalenecarboxylic acid, salicylic acid, 4-methylbenzoic acid, 3-methylbenzoic acid, phenoxyacetic acid, biphenylcarboxylic acid, acetic acid, propionic acid, butyric acid, octanoic acid, decanoic acid, dodecanoic acid, and stearic acid.

The crystalline polyester can be produced for the present invention according to common methods for polyester synthesis. For example, a desired polyester resin can be obtained by running an esterification reaction or transesterification reaction between the aforementioned carboxylic acid component and alcohol component and then running a polycondensation reaction according to the usual methods under a reduced pressure or with the introduction of nitrogen gas.

This esterification or transesterification reaction can be carried out as necessary using a common esterification catalyst or transesterification catalyst, e.g., sulfuric acid, titanium butoxide, dibutyltin oxide, tin 2-ethylhexanoate, manganese acetate, magnesium acetate, and so forth.

The polycondensation reaction can be carried out using a known catalyst, for example, a common polymerization catalyst such as titanium butoxide, dibutyltin oxide, tin 2-ethylhexanoate, tin acetate, zinc acetate, tin disulfide, antimony trioxide, germanium dioxide, and so forth. The polymerization temperature and the amount of catalyst may be determined as appropriate without particular limitations.

In order to raise the strength of the obtained crystalline polyester resin, the total monomer may be introduced all together in the esterification or transesterification reaction or polycondensation reaction. In addition, in order to minimize the low molecular weight component, a method may be used, for example, in which the difunctional monomer is reacted first followed then by the addition of the at least trifunctional monomer and reaction.

The molar ratio (carboxylic acid component/alcohol component) between the alcohol component and carboxylic acid component that are the starting monomers for the crystalline polyester resin is preferably at least 0.80 and not more than 1.20.

The content of the crystalline polyester resin in the present invention, expressed per 100 mass parts of the amorphous polyester resin, is preferably at least 1 mass parts and not more than 40 mass parts, more preferably at least 1 mass parts and not more than 22 mass parts, and even more preferably at least 2 mass parts and not more than 18 mass parts. The fixing performance and charge relaxation can co-exist in good balance when the crystalline polyester resin content is in the indicated range.

[Wax]

The toner of the present invention contains a wax. This wax can be exemplified by the following:

hydrocarbon waxes such as low molecular weight polyethylene, low molecular weight polypropylene, alkylene copolymers, microcrystalline waxes, paraffin waxes, and Fischer-Tropsch waxes; oxides of hydrocarbon waxes, e.g., oxidized polyethylene wax, and their block copolymers; waxes in which the main component is a fatty acid ester, such as carnauba wax; and waxes provided by the partial or complete deacidification of fatty acid esters, such as deacidified carnauba wax.

Additional examples are as follows: saturated linear fatty acids such as palmitic acid, stearic acid, and montanic acid; unsaturated fatty acids such as brassidic acid, eleostearic acid, and parinaric acid; saturated alcohols such as stearyl alcohol, aralkyl alcohols, behenyl alcohol, carnaubyl alcohol, ceryl alcohol, and melissyl alcohol; polyhydric alcohols such as sorbitol; esters between fatty acids such as palmitic acid, stearic acid, behenic acid, or montanic acid, and alcohols such as stearyl alcohol, aralkyl alcohol, behenyl alcohol, carnaubyl alcohol, ceryl alcohol, or melissyl alcohol; fatty acid amides such as linoleamide, oleamide, and lauramide; saturated fatty acid bisamides such as methylenebisstearamide, ethylenebiscapramide, ethylenebislauramide, and hexamethylenebisstearamide; unsaturated fatty acid amides such as ethylenebisoleamide, hexamethylenebisoleamide, N,N'-dioleyladipamide, and N,N'-dioleylsebacamide; aromatic bisamides such as m-xylenebisstearamide and N,N'-distearylisophthalamide; fatty acid metal salts (generally known as metal soaps) such as calcium stearate, calcium laurate, zinc stearate, and magnesium stearate; waxes provided by grafting onto an aliphatic hydrocarbon wax using a vinyl monomer such as styrene or acrylic acid; partial esters between a polyhydric alcohol and a fatty acid, such as behenic monoglyceride; and hydroxyl group-containing methyl ester compounds obtained by the hydrogenation of plant oils.

Among these waxes, hydrocarbon waxes such as paraffin waxes and Fischer-Tropsch waxes and fatty acid ester waxes such as carnauba wax are preferred from the standpoint of bringing about an improved low-temperature fixability and an enhanced hot offset resistance. Hydrocarbon waxes are more preferred for the present invention because they provide additional enhancements in the hot offset resistance.

The wax content is preferably at least 1.0 mass part and not more than 20.0 mass parts per 100 mass parts of the binder resin. When the wax content is in this range, this facilitates the ability to efficiently exhibit and retain the hot offset property at high temperatures.

In addition, when viewed from the standpoint of the co-existence between the hot offset property and the storability of the toner, in the endothermic curve provided by ramp up during measurement with a differential scanning calorimeter (DSC), the peak temperature of the maximum endothermic peak present in the temperature range from 30° C. to 200° C. is preferably at least 50° C. and not more than 110° C.

[Colorant]

The colorants (coloring materials) that can be incorporated in the toner of the present invention can be exemplified as follows.

The black colorants can be exemplified by carbon black and by black colorants obtained by color mixing using a yellow colorant, magenta colorant, and cyan colorant to give a black color. A pigment may be used by itself for the colorant, but the enhanced sharpness provided by the co-use of a dye with a pigment is more preferred from the standpoint of the image quality of full-color images.

The magenta colorant pigments can be exemplified by C.I. Pigment Red 1, 2, 3, 4, 5, 6, 7, 8, 9, 10, 11, 12, 13, 14, 15, 16, 17, 18, 19, 21, 22, 23, 30, 31, 32, 37, 38, 39, 40, 41, 48:2, 48:3, 48:4, 49, 50, 51, 52, 53, 54, 55, 57:1, 58, 60, 63, 64, 68, 81:1, 83, 87, 88, 89, 90, 112, 114, 122, 123, 146, 147, 150, 163, 184, 202, 206, 207, 209, 238, 269, and 282; C.I. Pigment Violet 19; and C.I. Vat Red 1, 2, 10, 13, 15, 23, 29, and 35.

The magenta colorant dyes can be exemplified by oil-soluble dyes such as C.I. Solvent Red 1, 3, 8, 23, 24, 25, 27, 30, 49, 81, 82, 83, 84, 100, 109, and 121; C.I. Disperse Red 9; C.I. Solvent Violet 8, 13, 14, 21, and 27; and C.I. Disperse Violet 1, and basic dyes such as C.I. Basic Red 1, 2, 9, 12, 13, 14, 15, 17, 18, 22, 23, 24, 27, 29, 32, 34, 35, 36, 37, 38, 39, and 40 and C.I. Basic Violet 1, 3, 7, 10, 14, 15, 21, 25, 26, 27, and 28.

The cyan colorant pigments can be exemplified by C.I. Pigment Blue 2, 3, 15:2, 15:3, 15:4, 16, and 17; C.I. Vat Blue 6; C.I. Acid Blue 45; and copper phthalocyanine pigments having 1 to 5 phthalimidomethyl groups substituted on the phthalocyanine skeleton.

C.I. Solvent Blue 70 is a cyan colorant dye.

The yellow colorant pigments can be exemplified by C.I. Pigment Yellow 1, 2, 3, 4, 5, 6, 7, 10, 11, 12, 13, 14, 15, 16, 17, 23, 62, 65, 73, 74, 83, 93, 94, 95, 97, 109, 110, 111, 120, 127, 128, 129, 147, 151, 154, 155, 168, 174, 175, 176, 180, 181, and 185 and by C.I. Vat Yellow 1, 3, and 20.

C.I. Solvent Yellow 162 is a yellow colorant dye.

The content of these colorants is preferably at least 0.1 mass parts and not more than 30.0 mass parts per 100 mass parts of the binder resin.

[Magnetic Body]

The toner of the present invention may be a magnetic toner or a nonmagnetic toner. In the case of use as a magnetic toner, a magnetic iron oxide is preferably used as the magnetic body. An iron oxide such as magnetite, maghematite, ferrite, and so forth is used as the magnetic iron oxide. The amount of magnetic iron oxide contained in the toner, per 100 mass parts of the binder resin, is preferably at least 25 mass parts and not more than 95 mass parts and more preferably at least 30 mass parts and not more than 45 mass parts.

[Charge Control Agent]

A charge control agent may as necessary also be incorporated in the toner of the present invention. For example, the negative-charging charge control agents can be exemplified by metal salicylate compounds, metal naphthoate compounds, metal dicarboxylate compounds, polymer compounds having sulfonic acid or carboxylic acid in the side chain, polymer compounds having sulfonate salt or sulfonate ester in the side chain, polymer compounds having carboxylate salt or carboxylate ester in the side chain, boron compounds, urea compounds, silicon compounds, and calixarene. The charge control agent may be internally added or externally added to the toner particle. The amount of addition of the charge control agent is preferably at least 0.2 mass parts and not more than 10.0 mass parts per 100 mass parts of the binder resin.

[Inorganic Fine Particles]

The toner particle of the present invention contains inorganic fine particles. The inorganic fine particles can be exemplified by inorganic fine particles selected from the group consisting of silica, alumina, magnesium oxide, titanium oxide, zirconium oxide, chromium oxide, cerium oxide, tin oxide, and zinc oxide, which are metal oxides. Other examples are inorganic fine particles selected from the group consisting of amorphous carbon (for example, carbon black), nitrides (for example, silicon nitride), carbides (for example, silicon carbide), and metal salts (for example, strontium titanate, calcium sulfate, barium sulfate, and calcium carbonate). A single metal oxide as above may be used by itself for the inorganic fine particles or a plurality of these metal oxides may be used. In addition, the inorganic fine particles may be provided by forming a composite of a plurality of metal oxides.

In the present invention, the inorganic fine particles are preferably silica particles or alumina particles and are more preferably silica particles. These inorganic fine particles have higher resistances and due to this the resistance of the toner is also raised and not only is charge relaxation in H/H environments then suppressed, but the toner also exhibits an excellent charge rise performance.

The number-average particle diameter (D1) of primary particles of the inorganic fine particles in the toner particle is preferably at least 6 nm and not more than 300 nm, more preferably at least 10 nm and not more than 150 nm, and still more preferably at least 15 nm and not more than 60 nm. When the number-average particle diameter (D1) of the primary particles is in the indicated range, the crystalline polyester fraction is covered more uniformly and at high concentrations. As a result, the charge stability is further increased and an excellent uniformity in the density in H/H environments is achieved.

The content of the inorganic fine particles in the toner particle, per 100 mass parts of the binder resin, is preferably at least 0.5 mass parts and not more than 15.0 mass parts, more preferably at least 0.5 mass parts and not more than 10.0 mass parts, and even more preferably at least 0.5 mass parts and not more than 5.0 mass parts. The fixing performance (bending resistance by the image) is excellent when the content of the inorganic fine particles is not more than 15.0 mass parts. An excellent inhibitory effect on charge relaxation is readily obtained when the content of the inorganic fine particles is at least 0.5 mass parts.

For example, the following methods may be used as the method for producing silica: flame fusion methods in which a silicon compound is converted into a gas and decomposition/melting is carried out in a flame; vapor-phase methods (dry silica or fumed silica) in which silicon tetrachloride is combusted at high temperatures together with a mixed gas of oxygen, hydrogen, and dilution gas (for example, nitrogen, argon, carbon dioxide); and wet methods (sol-gel silica) in which an alkoxysilane is subjected to hydrolysis and a condensation reaction under catalysis in a water-containing organic solvent, followed by removal of the solvent from the obtained silica sol suspension and drying.

Moreover, a method may also be used in which the silica particles provided by a production method as indicated above are brought to a desired number-average particle diameter using a classification process and/or a comminution process.

In order to further increase the inhibitory effect on charge relaxation in H/H environments, a silica produced by a vapor-phase method or flame fusion method is more preferred in the present invention because it has a higher resistance and is resistant to the effects of humidity.

This silica provided by a vapor-phase method is produced according to the heretofore known art. For example, the thermal decomposition and oxidation reaction of silicon tetrachloride gas in an oxyhydrogen flame can be used, wherein the basic reaction equation is as follows.

$$SiCl_4+2H_2+O_2 \rightarrow SiO_2+4HCl$$

It is also possible in this production process to obtain a composite fine powder of silica and another metal oxide by using, for example, aluminum chloride or another metal halide compound in combination with the silicon halide compound.

When silica produced by a vapor-phase method or flame fusion method is used in the present invention, the number-average particle diameter of the primary particles can be controlled through, for example, the feed rate of the starting gas, the feed amount of the combustible gas, and the oxygen ratio.

The alumina is preferably an alumina fine powder obtained by the Bayer method, the improved Bayer method, the ethylene chlorohydrin method, spark discharge in water, hydrolysis of an organoaluminum, thermal decomposition of aluminum, thermal decomposition of ammonium aluminum carbonate, or flame decomposition of aluminum chloride. With regard to the crystal system, any of α, β, γ, δ, ξ, η, θ, κ, χ, and ρ types, mixed crystal types of the preceding, and amorphous may be used, wherein the use of α, δ, γ, θ, mixed crystal types, and amorphous is preferred.

The inorganic fine particle is preferably a hydrophobed inorganic fine particle. There are no particular limitations on the hydrophobic treatment and known procedures can be used.

Silane coupling agents can be exemplified by the following: hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloroethyltrichlorosilane, chloromethyldimethylchlorosilane, triorganosilyl mercaptan, trimethylsilyl mercaptan, triorganosilyl acrylate, vinyldimethylacetoxysilane, dimethyldiethoxysilane, dimethyldimethoxysilane, diphenyldiethoxysilane, hexamethyldisiloxane, 1,3-divinyltetramethyldisiloxane, 1,3-diphenyltetramethyldisiloxane, and dimethylpolysiloxanes having 2 to 12 siloxane units in each molecule and having a single hydroxyl group on the silicon atom in the units in terminal position.

The silicone oil used to treat the inorganic fine particles can be exemplified by dimethylsilicone oils, alkyl-modified silicone oils, α-methylstyrene-modified silicone oils, chlorophenylsilicone oils, and fluorine-modified silicone oils. This should not be construed as limiting the silicone oils to the preceding. Known art can be used for the method of treating with a silicone oil. The following methods are examples here: silicic acid fine powder may be mixed with the silicone oil using a mixer; the silicone oil may be sprayed onto silicic acid fine powder using a sprayer; or the silicone oil may be dissolved in a solvent following by mixing with silicic acid fine powder. The treatment method is not limited to the preceding.

Hexamethyldisilazane is more preferably used as the surface treatment agent for the inorganic fine particles.

[Additional External Additives]

Additional external additives may be added in the present invention in order to improve the flowability and adjust the quantity of triboelectric charge.

This external additive is preferably an inorganic fine particle such as silica, titanium oxide, aluminum oxide, or strontium titanate. Mixing of the toner particle with the external additive may use a known mixer such as a Henschel mixing, but there is no limitation to a particular apparatus as long as mixing can be performed.

[Carrier]

Viewed from the standpoint of obtaining a stable image on a long-term basis, the toner of the present invention is preferably mixed with a magnetic carrier and used as a two-component developer.

A generally known magnetic carrier can be used here, for example, a magnetic body such as a surface-oxidized iron powder or an unoxidized iron powder, metal particles (e.g., of iron, lithium, calcium, magnesium, nickel, copper, zinc, cobalt, manganese, or a rare earth), alloy particles and oxide particles of the preceding, ferrite, and so forth, or a resin carrier having a magnetic body dispersed therein (known as a resin carrier), which contains a magnetic body and a binder resin holding the magnetic body in a dispersed state.

[Production Method]

The toner of the present invention can be produced by a heretofore known toner production method, e.g., an emulsion aggregation method, melt-kneading method, dissolution suspension method, and so forth, but there is no particular limitation to these.

The melt-kneading method is characterized by the melt-kneading of a toner composition that is the starting material for the toner particle and pulverization of the obtained kneaded material. An example of this production method is described in the following.

In a starting material mixing step, the materials that will constitute the toner particle, i.e., the binder resin, wax, and inorganic fine particles and as necessary other components such as an organometal compound, colorant, and so forth, are weighed out in prescribed amounts and are blended and mixed. The mixing apparatus can be exemplified by a double cone mixer, V-mixer, drum mixer, Supermixer, Henschel mixer, Nauta mixer, and Mechano Hybrid (Nippon Coke & Engineering Co., Ltd.).

The mixed material is then melt-kneaded and the other starting materials are thereby dispersed in the binder resin. A batch kneader, e.g., a pressure kneader or Banbury mixer, or a continuous kneader can be used in the melt-kneading step, and single-screw extruders and twin-screw extruders are the mainstream here because they offer the advantage of enabling continuous production. Examples here are the KTK twin-screw extruder (Kobe Steel, Ltd.), Model TEM twin-screw extruder (Toshiba Machine Co., Ltd.), PCM kneader (Ikegai Corp), Twin Screw Extruder (KCK), Co-Kneader (Buss AG), and Kneadex (Nippon Coke & Engineering Co., Ltd.). The resin composition yielded by melt-kneading may be rolled out using, for example, a two-roll mill, and may be cooled in a cooling step using, for example, water.

The cooled resin composition is then pulverized to a desired particle diameter in a pulverization step. In the pulverization step, for example, a coarse pulverization is performed using a grinder such as a crusher, hammer mill, or feather mill, followed, for example, by a fine pulverization using a fine pulverizer such as a Kryptron System (Kawasaki Heavy Industries, Ltd.), Super Rotor (Nisshin Engineering Co., Ltd.), or Turbo Mill (Turbo Kogyo Co., Ltd.) or using an air jet system.

The toner particle is then obtained as necessary by carrying out classification using a sieving apparatus or a classifier, e.g., an internal classification system such as the Elbow Jet (Nittetsu Mining Co., Ltd.) or a centrifugal classification system such as the Turboplex (Hosokawa Micron Corporation), TSP Separator (Hosokawa Micron Corporation), or Faculty (Hosokawa Micron Corporation).

When the toner of the present invention is produced by a melt-kneading method, the following production method is preferred that includes: a step of obtaining a resin composition by dispersing the inorganic fine particles in the melted crystalline polyester resin; a step of melt-kneading a mixture containing the resin composition, the amorphous polyester resin, and the wax; and a step of cooling and pulverizing the obtained kneaded material.

A resin composition is initially obtained by dispersing the inorganic fine particles in the melted crystalline polyester resin. There are no particular limitations on the production apparatus or production method as long as the crystalline polyester resin is dispersed in a molten state with the inorganic fine particles. It is particularly preferred in the present invention that the inorganic fine particles be dispersed in the crystalline polyester resin by melt-kneading a mixture containing the crystalline polyester resin and the inorganic fine particles.

A kneaded material is then obtained by additionally melt-kneading a mixture containing the resulting resin composition, the amorphous polyester resin, and the wax. A toner particle is obtained by going through a step in which the resulting kneaded material is cooled and pulverized. The presence of the inorganic fine particles in at least a certain ratio in the crystalline polyester fraction in the toner particle is readily brought about by proceeding through the aforementioned steps.

The emulsion aggregation method will now be described.

The emulsion aggregation method is a production method in which a core particle is produced by first preparing resin fine particles that are substantially smaller than the desired particle diameter and then aggregating these resin fine particles in an aqueous medium. A toner particle is produced in the emulsion aggregation method, for example, by proceeding through a step of emulsifying resin fine particles, an aggregation step, a fusion step, a cooling step, and a washing step. As desired, a core-shell toner can also be prepared by adding a shell formation step after the cooling step.

<The Step of Emulsifying Resin Fine Particles>

The resin fine particles can be prepared by a known method. For example, a dispersion of resin fine particles can be produced by adding the binder resin dissolved in an organic solvent to an aqueous medium; in combination with a surfactant and a polyelectrolyte, performing particulation and dispersion in the aqueous medium using a disperser such as an homogenizer; and then removing the solvent by heating or reducing the pressure. The organic solvent used to bring about dissolution may be any organic solvent that can dissolve the binder resin, but tetrahydrofuran, ethyl acetate, chloroform, and so forth are preferred from a solubility standpoint.

Viewed from the standpoint of the environmental burden, emulsification and dispersion are preferably carried out in an aqueous medium that substantially does not contain organic solvent, by adding the binder resin and surfactant, base, and so forth to the aqueous medium and using a disperser that applies a high-speed shear force, e.g., a Clearmix, homomixer, homogenizer, and so forth. In particular, the content of organic solvent having a boiling point of equal to or less than 100° C. is preferably not more than 100 μg/g. Outside of this range, an additional process for the removal and recovery of the organic solvent during toner production becomes necessary and a load is imposed on wastewater treatment measures. The organic solvent content in the aqueous medium can be measured using gas chromatography (GC).

There are no particular limitations on the surfactant used for emulsification, and this surfactant can be exemplified by anionic surfactants such as sulfate ester salts, sulfonic acid salts, carboxylic acid salts, phosphate esters, and soaps; cationic surfactants such as amine salts and quaternary ammonium salts; and nonionic surfactants such as polyethylene glycol types, ethylene oxide adducts on alkylphenols, and polyhydric alcohol types. A single surfactant may be used by itself or two or more may be used in combination.

The volume-based median diameter of the resin fine particles is preferably at least 0.05 μm and not more than 1.0 μm and is more preferably at least 0.05 and not more than 0.4 μm. When not more than 1.0 μm, a toner particle having a favorable volume-based median diameter of at least 4.0 μm and not more than 7.0 μm is readily obtained. The volume-based median diameter can be measured using a dynamic light scattering particle size distribution analyzer (Nanotrac UPA-EX150 from Nikkiso Co., Ltd.).

<The Aggregation Step>

The aggregation step is a step in which a liquid mixture is prepared by mixing fine particles of the wax and, as necessary, colorant fine particles into the resin fine particles described above and then aggregating the particles present in the liquid mixture to form aggregate particles. In a favorable example of a method for forming these aggregates, for example, an aggregating agent is added to and mixed into the liquid mixture with the appropriate application of temperature, mechanical force, and so forth.

The aggregating agent can be exemplified by the metal salts of monovalent metals, e.g., sodium, potassium, and so forth; the metal salts of divalent metals, e.g., calcium, magnesium, and so forth; and the metal salts of trivalent metals, e.g., iron, aluminum, and so forth.

The addition and mixing of the aggregating agent is preferably carried out at a temperature that does not exceed the glass transition temperature (Tg) of the resin fine particles present in the mixed liquid. When this mixing is performed using this temperature condition, mixing then proceeds in a state in which aggregation is stable. This mixing may be carried out using a known mixing device, homogenizer, mixer, and so forth.

While there are no particular limitations on the weight-average particle diameter of the aggregate formed in the aggregation step, it is preferably controlled to at least 4.0 μm and not more than 7.0 μm so as to be about the same as the weight-average particle diameter of the toner particle that will be obtained. This control is readily carried out by appropriately setting and varying, for example, the temperature during the addition and mixing of the aggregating agent and so forth and by appropriately setting and varying the conditions during the above-described stirring and mixing. The particle diameter distribution of the toner particle can be measured using a particle size distribution analyzer that employs the Coulter principle (Coulter Multisizer III, Beckman Coulter, Inc.).

<The Fusion Step>

The fusion step is a step in which the surface of the aggregate particle is smoothed over by carrying out fusion by heating the aforementioned aggregate particle to at least the glass transition temperature (Tg) of the resin. In order to prevent melt adhesion between the toner particles, a chelating agent, pH modifier, surfactant, and so forth may be added as appropriate prior to introduction into the primary fusion step.

The chelating agent can be exemplified by ethylenediaminetetraacetic acid (EDTA) and its salts with an alkali metal such as the Na salt, sodium gluconate, sodium tartrate, potassium citrate, sodium citrate, nitrilotriacetate (NTA) salts, and large amounts of water-soluble polymers that contain both the COOH and OH functionalities (polyelectrolytes).

The heating temperature should be between the glass transition temperature (Tg) of the binder resin present in the aggregates and the temperature at which the binder resin undergoes thermal decomposition. The heating/fusion time must be shorter when a higher heating temperature is used and longer when a lower heating temperature is used. That is, the heating/fusion time, while it cannot be unconditionally specified because it depends on the heating temperature, is generally from 10 minutes to 10 hours.

<The Cooling Step>

The cooling step is a step in which the temperature of the particle-containing aqueous medium is cooled to a temperature below the glass transition temperature (Tg) of the resin. Coarse particles are ultimately produced when cooling is not carried out to a temperature below the Tg. The specific cooling rate is at least 0.1° C./min and not more than 50° C./min.

<The Shell Formation Step>

As necessary, a shell formation step can also be inserted prior to the washing and drying step described below. The shell formation step is a step in which a shell is formed by the fresh addition and attachment of resin fine particles to the particles produced by the steps up to this point.

The resin fine particles added here may have the same structure as the binder resin fine particles used in the core, or may have a different structure.

There are no particular limitations on the resin constituting the shell layer, and the resins known for use in toner can be used, for example, polyester resins, vinyl polymers such as styrene-acrylic copolymers, epoxy resins, polycarbonate resins, and polyurethane resins. Polyester resins and styrene-acrylic copolymers are preferred among the preceding and polyester resins are more preferred from the standpoint of the fixing performance and durability. A polyester resin that has a rigid aromatic ring in the main chain has a flexibility comparable to that of vinyl polymers such as styrene-acrylic copolymers and as a consequence can provide the same mechanical strength even at a lower molecular weight than the vinyl polymer. Due to this, polyester resins are also preferred as resins adapted for low-temperature fixability.

A single resin may be used to form the shell layer in the present invention or a combination of two or more may be used.

<The Washing and Drying Step>

The particles produced proceeding through the above-described steps are subjected to washing and filtration using deionized water having a pH adjusted with sodium hydroxide or potassium hydroxide, followed by washing with deionized water and filtration a plurality of times. The emulsion-aggregated toner particle can then be obtained by drying.

When the toner of the present invention is produced by the emulsion aggregation method, the following production method is preferred that includes: a step of obtaining a resin composition by dispersing the inorganic fine particles in the melted crystalline polyester resin; a step of dispersing fine particles of this resin composition, fine particles of the amorphous polyester resin, and fine particles of the wax; a step of forming an aggregate particle containing the fine particles of the resin composition, the fine particles of the amorphous polyester resin, and the fine particles of the wax; and a step of inducing fusion of the aggregate particle.

A resin composition is initially obtained by dispersing the inorganic fine particles in the melted crystalline polyester resin. There are no particular limitations on the production apparatus or production method as long as the crystalline polyester resin is mixed in a molten state with the inorganic fine particles. It is particularly preferred in the present invention that the inorganic fine particles be dispersed in the crystalline polyester resin by melt-kneading a mixture that contains the crystalline polyester resin and the inorganic fine particles.

Dispersed resin fine particles containing the inorganic fine particles are then obtained by using this resin composition in the emulsification step in which the resin fine particle dispersion is produced. Mixing of the fine particles of this inorganic fine particle-containing resin composition, fine particles of the amorphous polyester resin, fine particles of the wax, and as necessary colorant fine particles and so forth is also carried out. The toner particle is used that is obtained by subjecting this to the aforementioned aggregation step, fusion step, cooling step, and washing step. Proceeding through the aforementioned steps enables the facile incorporation of the inorganic fine particles in at least a certain ratio in the crystalline polyester resin fraction in the toner particle.

The following constitution is preferred in the case of use for the toner of the present invention of a resin composition obtained by melt-kneading a mixture containing the crystalline polyester resin and the inorganic fine particles. The content of the inorganic fine particles in the resin composition, expressed per 100 mass parts of the crystalline polyester resin, is preferably at least 3 mass parts and not more than 50 mass parts, more preferably at least 5 mass parts and not more than 50 mass parts, and even more preferably at least 10 mass part and not more than 50 mass parts. When the content of the inorganic fine particles in the resin composition is in the indicated range, a uniform dispersion is assumed by the inorganic fine particles in the crystalline polyester resin and the charge stability of the toner is further increased.

A heat-treatment step may be carried out on an optional basis in the present invention wherein an additive, e.g., an inorganic fine powder and/or resin particles, is added with mixing and dispersion to the surface of the obtained toner particle and while in this dispersed state the additive is attached to the toner particle surface by a surface treatment using a hot air. The toner particle shape may also be adjusted by proceeding through a heat-treatment step.

An external additive may on an optional basis be added to and mixed with (externally added to) the toner particle produced by a production method as described in the preceding. Examples are inorganic fine powders of, e.g., silica, alumina, titania, calcium carbonate, and so forth, and resin particles of, e.g., vinyl resin, polyester resin, silicone resin, and so forth. These inorganic fine powders and resin particles function as external additives for control of the charging performance, as a flowability aid, as a cleaning aid, and so forth. Examples of the mixing apparatus are the double cone mixer, V-mixer, drum mixer, Supermixer, Henschel mixer, Nauta mixer, and Mechano Hybrid (Nippon Coke & Engineering Co., Ltd.).

The methods for measuring the individual properties are described in the following.

<Method for Measuring the Softening Point (Tm) of the Amorphous Polyester Resin>

The softening point of the resin was measured according to the manual provided with the instrument, using a constant-load extrusion-type capillary rheometer, i.e., a "Flowtester CFT-500D Flow Property Evaluation Instrument" (Shimadzu Corporation). With this instrument, the measurement sample filled in a cylinder is heated and melted while a constant load is applied by a piston from the top of the measurement sample; the melted measurement sample is extruded from a die at the bottom of the cylinder; and a flow curve showing the relationship between piston stroke and temperature is obtained from this.

The "melting temperature by the ½ method", as described in the manual provided with the "Flowtester CFT-500D Flow Property Evaluation Instrument", was used as the softening point in the present invention. The melting temperature by the ½ method is determined as follows. First, ½ of the difference between Smax, which is the piston stroke at the completion of outflow, and Smin, which is the piston stroke at the start of outflow, is determined (this value is designated as X, where X=(Smax−Smin)/2). The temperature of the flow curve when the piston stroke in the flow curve reaches X is the melting temperature by the ½ method.

The measurement sample used is prepared by subjecting approximately 1.0 g of the resin to compression molding for approximately 60 seconds at approximately 10 MPa in a 25° C. environment using a tablet compression molder (for example, the NT-100H, NPa System Co., Ltd.) to provide a cylindrical shape with a diameter of approximately 8 mm.

The measurement conditions with the CFT-500D are as follows.

test mode: rising temperature method
start temperature: 50° C.
saturated temperature: 200° C.
measurement interval: 1.0° C.
ramp rate: 4.0° C./min
piston cross section area: 1.000 $cm^2$
test load (piston load): 10.0 kgf (0.9807 MPa)
preheating time: 300 seconds
diameter of die orifice: 1.0 mm
die length: 1.0 mm <Measurement of the Glass Transition Temperature (Tg) of the Amorphous Polyester Resin>

The glass transition temperature of the resin is measured based on ASTM D 3418-82 using a "Q1000" (TA Instruments) differential scanning calorimeter.

Temperature correction in the instrument detection section is performed using the melting points of indium and zinc, and the amount of heat is corrected using the heat of fusion of indium. Specifically, approximately 5 mg of the resin is exactly weighed out and this is introduced into an aluminum pan, and the measurement is run at a ramp rate of 10° C./min in the measurement temperature range between 30° C. and 200° C. using an empty aluminum pan as reference. The temperature is raised to 180° C. and maintained there for 10 minutes followed by cooling to 30° C. and then reheating. The change in the specific heat in the temperature range of 30° C. to 100° C. is obtained during this second ramp-up process. The glass transition temperature (Tg) of the resin is taken to be the point at the intersection between the differential heat curve and the line for the midpoint for the baselines for prior to and subsequent to the appearance of the change in the specific heat.

<Measurement of the Weight-Average Molecular Weight and Peak Molecular Weight of the Crystalline Polyester and Amorphous Polyester Resin>

The molecular weight distribution of the THF-soluble matter in the resin is measured as follows using gel permeation chromatography (GPC).

The column is stabilized in a heated chamber at 40° C.; tetrahydrofuran (THF) is introduced as solvent at a flow rate of 1 mL per minute into the column at this temperature; and approximately 100 μL of the THF sample solution is introduced and the measurement is carried out. To measure the molecular weight of the sample, the molecular weight distribution possessed by the sample is calculated from the relationship between the counts value and the logarithmic value on a calibration curve constructed using several different monodisperse polystyrene standard samples. For example, standard polystyrene samples having molecular weights of approximately $10^2$ to $10^7$ from Tosoh Corporation or Showa Denko K.K. may be used as standard polystyrene samples for construction of the calibration curve, and standard polystyrene samples at approximately 10 points or more are suitably used. An RI (refractive index) detector is used for the detector. For the column, a combination of a plurality of commercially available polystyrene gel columns is favorably used, wherein the following combinations are examples: the combination of Shodex GPC KF-801, 802, 803, 804, 805, 806, 807, and 800P from Showa Denko K.K. and the combination of TSKgel G1000H($H_{XL}$), G2000H ($H_{XL}$), G3000H($H_{XL}$), G4000H($H_{XL}$), G5000H($H_{XL}$), G6000H($H_{XL}$), G7000H($H_{XL}$), and TSK guard column from Tosoh Corporation.

The sample is prepared proceeding as follows.

50 mg of the sample is introduced into 10 mL of THF; this is held for several hours at 25° C.; thorough mixing with the THF is carried out by thoroughly shaking (until sample aggregates are absent); and standing at quiescence is performed for at least an additional 12 hours. The total standing time in the THF is brought to 24 hours. This is followed by passage through a sample treatment filter (pore size of at least 0.2 μm and not more than 0.5 μm, for example, a Sample Pretreatment Cartridge H-25-2 (Tosoh Corporation) can be used) to provide the GPC sample.

<Measurement of the Melting Point of the Crystalline Polyester Resin and the Wax>

For the melting point of the crystalline polyester resin and the wax, the peak temperature of the maximum endothermic peak in the DSC curve measured based on ASTM D 3418-82 using a "Q2000" (TA Instruments) differential scanning calorimeter is taken to be the melting point.

Temperature correction in the instrument detection section is performed using the melting points of indium and zinc, and the amount of heat is corrected using the heat of fusion of indium. Specifically, approximately 2 mg of the sample is exactly weighed out and this is introduced into an aluminum pan, and the measurement is run at a ramp rate of 10° C./min in the measurement temperature range between 30° C. and 200° C. using an empty aluminum pan as reference. For the measurement, the temperature is raised to 200° C. followed by cooling to 30° C. and then reheating. The melting point is taken to be the temperature of the maximum endothermic peak in the DSC curve in the 30° C. to 200° C. temperature range in this second ramp-up process.

<Measurement of the Weight-Average Particle Diameter (D4) of the Toner>

The weight-average particle diameter (D4) of the toner is determined by performing measurement in 25,000 channels for the number of effective measurement channels and analyzing the measurement data using a "Coulter Counter Multisizer 3" (registered trademark, Beckman Coulter, Inc.), a precision particle size distribution measurement instrument operating on the pore electrical resistance method and equipped with a 100 μm aperture tube, and using the accompanying dedicated software, i.e., "Beckman Coulter Multisizer 3 Version 3.51" (Beckman Coulter, Inc.), to set the measurement conditions and analyze the measurement data. The aqueous electrolyte solution used for the measurements is prepared by dissolving special-grade sodium chloride in deionized water to provide a concentration of approximately 1 mass % and, for example, "Isoton II" (Beckman Coulter, Inc.) can be used.

The dedicated software is configured as follows prior to measurement and analysis.

In the "modify the standard operating method (SOM)" screen in the dedicated software, the total count number in the control mode is set to 50,000 particles; the number of measurements is set to 1 time; and the Kd value is set to the value obtained using "standard particle 10.0 μm" (Beckman Coulter, Inc.). The threshold value and noise level are automatically set by pressing the threshold value/noise level measurement button. In addition, the current is set to 1,600 μA; the gain is set to 2; the electrolyte is set to Isoton II; and a check is entered for the post-measurement aperture tube flush. In the "setting conversion from pulses to particle diameter" screen of the dedicated software, the bin interval is set to logarithmic particle diameter; the particle diameter bin is set to 256 particle diameter bins; and the particle diameter range is set to from 2 μm to 60 μm.

The specific measurement procedure proceeds according to the following (1) to (7).

(1) Approximately 200 mL of the above-described aqueous electrolyte solution is introduced into a 250-mL roundbottom glass beaker intended for use with the Multisizer 3 and this is placed in the sample stand and counterclockwise stirring with the stirrer rod is carried out at 24 rotations per second. Contamination and air bubbles within the aperture tube are removed using the "aperture flush" function of the dedicated software.

(2) Approximately 30 mL of the above-described aqueous electrolyte solution is introduced into a 100-mL flatbottom glass beaker. To this is added as dispersing agent approximately 0.3 mL of a dilution prepared by the three-fold (mass) dilution with deionized water of "Contaminon N" (a 10 mass % aqueous solution of a neutral pH 7 detergent for cleaning precision measurement instrumentation, comprising a nonionic surfactant, anionic surfactant, and organic builder, Wako Pure Chemical Industries, Ltd.).

(3) A prescribed amount of deionized water is introduced into the water tank of an "Ultrasonic Dispersion System Tetora 150" (Nikkaki Bios Co., Ltd.), which is an ultrasound disperser with an electrical output of 120 W and equipped with two oscillators (oscillation frequency=50 kHz) disposed such that the phases are displaced by 180°, and approximately 2 mL of Contaminon N is added to this water tank.

(4) The beaker described in (2) is set into the beaker holder opening on the ultrasound disperser and the ultrasound disperser is started. The vertical position of the beaker is adjusted in such a manner that the resonance condition of the surface of the aqueous electrolyte solution within the beaker is at a maximum.

(5) While the aqueous electrolyte solution within the beaker set up according to (4) is being irradiated with ultrasound, approximately 10 mg of the toner is added to the aqueous electrolyte solution in small aliquots and dispersion is carried out. The ultrasound dispersion treatment is continued for an additional 60 seconds. The water temperature in the water tank is adjusted as appropriate during ultrasound dispersion to be at least 10° C. and not more than 40° C.

(6) Using a pipette, the aqueous electrolyte solution prepared in (5), in which toner is dispersed, is dripped into the roundbottom beaker set in the sample stand as described in (1) with adjustment to provide a measurement concentration of approximately 5%. Measurement is then performed until the number of measured particles reaches 50,000.

(7) The measurement data is analyzed by the previously cited dedicated software provided with the instrument and the weight-average particle diameter (D4) is calculated. When set to graph/volume % with the dedicated software, the "average diameter" on the analysis/volumetric statistical value (arithmetic average) screen is the weight-average particle diameter (D4).

<Measurement of the Toner Particle Cross Section by TEM Observation>

Observation of the cross section of the toner particle using a transmission electron microscope (TEM) can be conducted proceeding as follows. The following were evaluated for the present invention in the observation of the toner particle cross section: the area Sc taken up by the crystalline polyester, the area S1 taken up by the inorganic fine particles present in the crystalline polyester resin portion, the total area S2 taken up by the inorganic fine particles, and the cross-sectional area St of the toner particle.

The crystalline polyester resin is obtained as a clear contrast by the execution of ruthenium tetroxide staining of the toner particle cross section. The crystalline polyester resin stains more weakly than the organic components constituting the interior of the toner particle. This is thought to be due to the following: due to the existence of, for example, density differences, the infiltration of the staining material into the crystalline polyester resin is weaker than for the organic components in the interior of the toner particle.

The amount of the ruthenium atom varies as a function of the strength/weakness of staining, and as a result these atoms are present in large amounts in a strongly stained region and transmission of the electron beam then does not occur and black appears in the observed image. The electron beam is readily transmitted in weakly stained regions, which then appear in white on the observed image.

An Os film (5 nm) and a naphthalene film (20 nm) were formed on a toner as protective films using an osmium plasma coater (OPC80T, Filgen, Inc.), and, after embedding with D800 photocurable resin (JEOL Ltd.), toner particle cross sections with a film thickness of 60 nm (or 70 nm) were prepared using an ultrasound ultramicrotome (UC7, Leica Microsystems) and a slicing rate of 1 mm/s.

Using a vacuum electronic staining device (VSC4R1H, Filgen, Inc.), the obtained cross sections were stained for 15 minutes in a 500 Pa $RuO_4$ gas atmosphere, and STEM observation was carried out using the STEM function of a TEM (JEM2800, JEOL Ltd.). Acquisition was carried out at a STEM probe size of 1 nm and an image size of 1,024×1,024 pixels.

"Image-Pro Plus (Media Cybernetics, Inc.)" image processing software is used on the obtained images.

The following are measured on the obtained images: the area Sc taken up by the crystalline polyester, the area S1 taken up by the inorganic fine particles present in the crystalline polyester resin portion, the total area S2 taken up by the inorganic fine particles, and the cross-sectional area St of the toner particle. Observation of the cross section is carried out on 20 toner particles in the present invention, and calculating an arithmetic average value. The toner particle cross sections submitted to observation exhibit a major diameter R (μm) that satisfies the relationship $0.9 \leq R/D4 \leq 1.1$ with respect to the weight-average particle diameter (D4).

<Method for Measuring the Number-Average Particle Diameter (D1) of Primary Particles of the Inorganic Fine Particles>

Toner particles dispersed in a water-soluble resin were introduced into a cryomicrotome (Ultracut UCT, Leica Microsystems) device. This device was cooled to −80° C. using liquid nitrogen in order to freeze the water-soluble resin in which the toner particles were dispersed. The frozen water-soluble resin was trimmed using a glass knife so that the slicing section shape was approximately 0.1 mm in width and approximately 0.2 mm in length. Then, ultrathin sections (thickness setting: 70 nm) of the water-soluble resin-containing toner particles were made using a diamond knife and were transferred using an eyelash probe onto a grid mesh for TEM observation. The ultrathin sections of the water-soluble resin-containing toner particles were returned to room temperature and the water-soluble resin was then dissolved with pure water to yield the observation sample for the transmission electron microscope (TEM). This sample was observed using an H-7500 transmission electron microscope from Hitachi, Ltd. at an acceleration voltage of 100 kV and magnified photographs were taken of the toner particle cross sections. The magnification for the magnified photographs was 20,000×.

The TEM image obtained from this photography was converted into binary image data using Image-Pro Plus 5.1J (Media Cybernetics, Inc.) image analysis software. After this, analysis was randomly performed only on the inorganic fine particles.

With regard to the number-average particle diameter of primary particles of the inorganic fine particles, the average value of the major axis and minor axis of a particle was used for the primary particle diameter. 100 primary particles were randomly selected, and the number average of these primary particle diameters was used as the number-average particle diameter (D1) of primary particles of the inorganic fine particles.

EXAMPLES

The present invention is described below using production examples and examples. The number of parts in the following description is on a mass parts basis.

Amorphous Polyester Resin Production Example

Low Molecular Weight Amorphous Polyester Resin (L) Production Example 1 polyoxypropylene(2.2)-2,2-bis(4-hydroxyphenyl)propane: 72.0 mass parts (0.20 mol, 100.0 mol % with respect to the total number of moles of polyhydric alcohol)

terephthalic acid: 28.0 mass parts (0.17 mol, 96.2 mol % with respect to the total number of moles of polybasic carboxylic acid)

tin 2-ethylhexanoate (esterification catalyst): 0.5 mass parts

These substances were weighed into a reaction vessel fitted with a condenser, stirrer, nitrogen introduction line, and thermocouple. After then substituting the interior of the flask with nitrogen gas, the temperature was gradually raised while stirring and a reaction was carried out for 4 hours while stirring at a temperature of 200° C. The pressure within the reaction vessel was dropped to 8.3 kPa; holding was carried out for 1 hour; and cooling was then performed to 180° C. and the pressure was returned to atmospheric pressure (first reaction step).

trimellitic anhydride: 3 mass parts (0.01 mol, 3.8 mol % with respect to the total number of moles of polybasic carboxylic acid)

tert-butylcatechol (polymerization inhibitor): 0.1 mass parts

These substances were subsequently added; the pressure within the reaction vessel was dropped to 8.3 kPa; a reaction was run for 1 hour while holding in this condition at a temperature of 180° C.; and the temperature was reduced and the reaction was stopped after confirming that a softening point, as measured according to ASTM D 36-86, of 94° C. had been reached (second reaction step), thereby yielding a low molecular weight amorphous polyester resin (L)-1. The obtained low molecular weight amorphous polyester resin (L)-1 had a softening point (Tm) of 94° C., a glass transition temperature (Tg) of 57° C., a weight-average molecular weight of 4,700, and an acid value of 5.0 mg KOH/g.

High Molecular Weight Amorphous Polyester Resin (H) Production Example 1 polyoxypropylene(2.2)-2,2-bis(4-hydroxyphenyl)propane: 72.3 mass parts (0.20 mol, 100.0 mol % with respect to the total number of moles of polyhydric alcohol)

terephthalic acid: 18.3 mass parts (0.11 mol, 65.0 mol % with respect to the total number of moles of polybasic carboxylic acid)

fumaric acid: 2.9 mass parts (0.03 mol, 15.0 mol % with respect to the total number of moles of polybasic carboxylic acid)

tin 2-ethylhexanoate (esterification catalyst): 0.5 mass parts

These substances were weighed into a reaction vessel fitted with a condenser, stirrer, nitrogen introduction line, and thermocouple. After then substituting the interior of the flask with nitrogen gas, the temperature was gradually raised while stirring and a reaction was carried out for 2 hours while stirring at a temperature of 200° C.

The pressure within the reaction vessel was dropped to 8.3 kPa; holding was carried out for 1 hour; and cooling was then performed to 180° C. and the pressure was returned to atmospheric pressure (first reaction step).

trimellitic anhydride: 6.5 mass parts (0.03 mol, 20.0 mol % with respect to the total number of moles of polybasic carboxylic acid)

tert-butylcatechol (polymerization inhibitor): 0.1 mass parts

These substances were subsequently added; the pressure within the reaction vessel was dropped to 8.3 kPa; a reaction was run for 15 hours while holding in this condition at a temperature of 160° C.; and the temperature was reduced and the reaction was stopped after confirming that a softening point, as measured according to ASTM D 36-86, of 132° C. had been reached (second reaction step), thereby yielding a high molecular weight amorphous polyester resin (H)-1. The obtained high molecular weight amorphous polyester resin (H)-1 had a softening point (Tm) of 132° C., a glass transition temperature (Tg) of 61° C., a peak molecular weight of 13,200, and an acid value of 23.3 mg KOH/g.

Crystalline Polyester Resin Production Example 1

| | |
|---|---|
| 1,6-hexanediol | 50.0 mass parts |
| dodecanedioic acid | 50.0 mass parts |
| tin dioctylate | 1.0 mass part |

These substances were weighed into a reaction vessel fitted with a condenser, stirrer, nitrogen introduction line, and thermocouple. After then substituting the interior of the flask with nitrogen gas, the temperature was gradually raised while stirring and a reaction was carried out for 6 hours while stirring at a temperature of 140° C. The reaction was then run while raising the temperature to 200° C. at 10° C./hour to obtain a crystalline polyester resin 1. The obtained crystalline polyester resin 1 had a weight-average molecular weight of 10,000 and had a maximum endothermic peak at 70° C. in the DSC curve provided by differential scanning calorimetric analysis.

Resin Composition Production Example

Resin Composition Production Example 1

| | |
|---|---|
| crystalline polyester resin 1 | 100.0 mass parts |
| hydrophobic silica fine particles having a number-average primary particle diameter of 40 nm and surface treated with 10 mass % hexamethyldisilazane | 20.0 mass parts |

These starting materials were mixed using a Henschel mixer (Model FM75J, Mitsui Miike Chemical Engineering Machinery Co., Ltd.) at a rotation rate of 20 $s^{-1}$ and for a rotation time of 5 minutes, followed by kneading with a twin-screw kneader (Model PCM-30, Ikegai Corp) set to a temperature of 75° C. The obtained kneaded material was cooled and was pulverized using a hammer mill to 0.5 mm and below to provide a resin composition 1.

Production Example for Resin Compositions 2 to 14

Resin compositions 2 to 14 were obtained proceeding as in Production Example 1, but using the inorganic fine particles shown in Table 1 and changing the type and mixing ratio with the crystalline polyester resin as indicated in Table 2.

TABLE 1

| | | surface treatment | | | |
|---|---|---|---|---|---|
| inorganic fine particle No. | number-average primary particle diameter (D1) (nm) | type | treatment agent | treatment amount (mass %) | production method |
| 1 | 40 | silica | hexamethyldisilazane | 10 | flame fusion method |
| 2 | 60 | silica | hexamethyldisilazane | 10 | flame fusion method |
| 3 | 15 | silica | hexamethyldisilazane | 10 | flame fusion method |
| 4 | 10 | silica | hexamethyldisilazane | 10 | vapor-phase method |

TABLE 1-continued

| inorganic fine particle No. | number-average primary particle diameter (D1) (nm) | type | surface treatment: treatment agent | surface treatment: treatment amount (mass %) | surface treatment: production method |
|---|---|---|---|---|---|
| 5 | 6 | silica | hexamethyldisilazane | 15 | vapor-phase method |
| 6 | 4 | silica | hexamethyldisilazane | 15 | vapor-phase method |
| 7 | 150 | silica | hexamethyldisilazane | 8 | sol-gel method |
| 8 | 300 | alumina | hexamethyldisilazane | 8 | sintering method |
| 9 | 510 | magnesium oxide | hexamethyldisilazane | 8 | sintering method |

| | crystalline polyester: Production Example No. | crystalline polyester: amount of addition (parts) | inorganic fine particle: inorganic fine particle No. | inorganic fine particle: amount of addition (parts) |
|---|---|---|---|---|
| resin composition 1 | 1 | 100 | 1 | 20 |
| resin composition 2 | 1 | 100 | 1 | 50 |
| resin composition 3 | 1 | 100 | 1 | 35 |
| resin composition 4 | 1 | 100 | 1 | 10 |
| resin composition 5 | 1 | 100 | 1 | 5 |
| resin composition 6 | 1 | 100 | 1 | 3 |
| resin composition 7 | 1 | 100 | 3 | 5 |
| resin composition 8 | 1 | 100 | 4 | 5 |
| resin composition 9 | 1 | 100 | 5 | 5 |
| resin composition 10 | 1 | 100 | 6 | 5 |
| resin composition 11 | 1 | 100 | 2 | 50 |
| resin composition 12 | 1 | 100 | 7 | 50 |
| resin composition 13 | 1 | 100 | 8 | 50 |
| resin composition 14 | 1 | 100 | 9 | 50 |

Example 1

Toner 1 Production Example

| | |
|---|---|
| low molecular weight amorphous polyester resin (L)-1 | 75.0 mass parts |
| high molecular weight amorphous polyester resin (H)-1 | 25.0 mass parts |
| resin composition 1 (corresponds to 10.0 mass parts of crystalline polyester) | 12.0 mass parts |
| aluminum 3,5-di-t-butylsalicylate compound | 0.5 mass parts |
| Fischer-Tropsch wax (peak temperature of maximum endothermic peak = 90° C.) | 5.0 mass parts |
| C.I. Pigment Blue 15:3 | 5.0 mass parts |

The starting materials indicated in the formulation above were mixed using a Henschel mixer (Model FM75J, Mitsui Miike Chemical Engineering Machinery Co., Ltd.) at a rotation rate of 20 $s^{-1}$ and for a rotation time of 5 minutes, followed by kneading with a twin-screw kneader (Model PCM-30, Ikegai Corporation) set to a temperature of 125° C. The obtained kneaded material was cooled and was coarsely pulverized using a hammer mill to 1 mm and below to provide a coarsely pulverized material. The obtained coarsely pulverized material was finely pulverized using a mechanical pulverizer (T-250, Turbo Kogyo Co., Ltd.). Classification was additionally performed using a rotary classifier (200TSP, Hosokawa Micron Corporation) to obtain a toner particle. A classification rotor rotation rate of 50.0 $s^{-1}$ was used as an operating condition for the rotary classifier (200TSP, Hosokawa Micron Corporation). The obtained toner particle had a weight-average particle diameter (D4) of 5.7 μm.

To 100.0 mass parts of the obtained toner particle were added 0.5 mass parts of titanium oxide fine particles that had an average primary particle diameter of 50 nm and that had been surface treated with 15.0 mass % of isobutyltrimethoxysilane and 1.0 mass part of hydrophobic silica fine particles that had an average primary particle diameter of 15 nm and that had been surface treated with 20.0 mass % hexamethyldisilazane; mixing was performed with a Henschel mixer (Model FM75J, Mitsui Miike Chemical Engineering Machinery Co., Ltd.); and passage through an ultrasound vibrating screen with an aperture of 54 μm was carried out to obtain a toner 1.

In the DSC curve generated by differential scanning calorimetry, the obtained toner 1 had an endothermic peak originating with the crystalline polyester resin at 70° C. and an endothermic peak originating with the wax component at 90° C. The toner 1 was also subjected to TEM observation of its cross section. The results of these measurements are given in Table 4.

Using a V-mixer (Model V-10, Tokuju Kosakusho Co., Ltd.), a two-component developer 1 was obtained by mixing the toner 1 with silicone resin-surface-coated magnetic ferrite carrier particles (number-average particle diameter=35 μm) at 0.5 $s^{-1}$ for 5 minutes so as to yield a toner concentration of 9 mass %. The evaluations described below were carried out using this two-component developer 1, and the results are given in Table 5.

Examples 3 to 25 and Comparative Examples 1 and 2

Toners 3 to 27 and two-component developers 3 to 27 were prepared proceeding as in Example 1, but changing the crystalline polyester resin, the resin composition, and the inorganic fine particle as shown in Table 3. The obtained developers were evaluated proceeding as in Example 1. The measurement results for the toners are given in Table 4, and the results of the evaluation of the developers are given in Table 5.

TABLE 3

| developer No. | toner No. | amorphous polyester resin: amount of (L)-1 addition (parts) | amorphous polyester resin: amount of (H)-1 addition (parts) | crystalline polyester 1: amount of addition (parts) | resin composition: Production Example No. | resin composition: amount of addition (parts) |
|---|---|---|---|---|---|---|
| 1 | 1 | 75.0 | 25.0 | — | 1 | 12.0 |
| 2 | 2 | 70.0 | 30.0 | — | 1 | 12.0 |
| 3 | 3 | 75.0 | 25.0 | — | 2 | 5.7 |
| 4 | 4 | 75.0 | 25.0 | — | 3 | 7.4 |
| 5 | 5 | 75.0 | 25.0 | — | 4 | 24.2 |
| 6 | 6 | 75.0 | 25.0 | — | 2 | 1.5 |
| 7 | 7 | 75.0 | 25.0 | — | 2 | 12.0 |
| 8 | 8 | 75.0 | 25.0 | — | 2 | 15.0 |
| 9 | 9 | 75.0 | 25.0 | — | 5 | 10.5 |
| 10 | 10 | 75.0 | 25.0 | — | 6 | 10.3 |
| 11 | 11 | 75.0 | 25.0 | — | 7 | 10.5 |
| 12 | 12 | 75.0 | 25.0 | — | 8 | 10.5 |
| 13 | 13 | 75.0 | 25.0 | — | 9 | 10.5 |
| 14 | 14 | 75.0 | 25.0 | — | 10 | 10.5 |
| 15 | 15 | 75.0 | 25.0 | — | 2 | 18.0 |
| 16 | 16 | 75.0 | 25.0 | — | 11 | 18.0 |
| 17 | 17 | 75.0 | 25.0 | — | 12 | 18.0 |
| 18 | 18 | 75.0 | 25.0 | — | 13 | 18.0 |
| 19 | 19 | 75.0 | 25.0 | — | 14 | 18.0 |
| 20 | 20 | 75.0 | 25.0 | — | 14 | 27.0 |
| 21 | 21 | 75.0 | 25.0 | — | 14 | 33.0 |
| 22 | 22 | 75.0 | 25.0 | — | 14 | 42.0 |
| 23 | 23 | 75.0 | 25.0 | — | 14 | 60.0 |
| 24 | 24 | 75.0 | 25.0 | — | 14 | 66.0 |
| 25 | 25 | 75.0 | 25.0 | 12.0 | — | — |
| 26 | 26 | 75.0 | 25.0 | 28.0 | — | — |
| 27 | 27 | 75.0 | 25.0 | 28.0 | — | — |

| developer No. | inorganic fine particle: Production Example No. | inorganic fine particle: amount of addition (parts) | amount of crystalline polyester per 100 parts of amorphous polyester (parts) | amount of inorganic fine particles per 100 parts of binder resin (parts) | toner particle production method |
|---|---|---|---|---|---|
| 1 | — | — | 10.0 | 1.8 | melt-kneading |
| 2 | — | — | 10.0 | 1.8 | emulsion aggregation |
| 3 | — | — | 3.8 | 1.8 | melt-kneading |
| 4 | — | — | 5.5 | 1.8 | melt-kneading |
| 5 | — | — | 22.0 | 1.8 | melt-kneading |
| 6 | — | — | 1.0 | 0.5 | melt-kneading |
| 7 | — | — | 8.0 | 3.7 | melt-kneading |
| 8 | — | — | 10.0 | 4.5 | melt-kneading |
| 9 | — | — | 10.0 | 0.5 | melt-kneading |
| 10 | — | — | 10.0 | 0.3 | melt-kneading |
| 11 | — | — | 10.0 | 0.5 | melt-kneading |
| 12 | — | — | 10.0 | 0.5 | melt-kneading |
| 13 | — | — | 10.0 | 0.5 | melt-kneading |
| 14 | — | — | 10.0 | 0.5 | melt-kneading |
| 15 | — | — | 12.0 | 5.4 | melt-kneading |
| 16 | — | — | 12.0 | 5.4 | melt-kneading |
| 17 | — | — | 12.0 | 5.4 | melt-kneading |
| 18 | — | — | 12.0 | 5.4 | melt-kneading |
| 19 | — | — | 12.0 | 5.4 | melt-kneading |
| 20 | — | — | 18.0 | 7.6 | melt-kneading |
| 21 | — | — | 22.0 | 9.0 | melt-kneading |
| 22 | — | — | 28.0 | 10.9 | melt-kneading |
| 23 | — | — | 40.0 | 14.3 | melt-kneading |
| 24 | — | — | 44.0 | 15.3 | melt-kneading |
| 25 | inorganic fine particle 1 | 5.4 | 12.0 | 4.8 | melt-kneading |
| 26 | — | — | 28.0 | 0.0 | melt-kneading |
| 27 | inorganic fine particle 9 | 10.9 | 28.0 | 8.5 | melt-kneading |

TABLE 4

| Toner No. | Sc | S1 | S2 | S1/Sc | Sc/St | S1/S2 |
|---|---|---|---|---|---|---|
| 1 | 0.070 | 0.032 | 0.038 | 0.5 | 0.07 | 0.8 |
| 2 | 0.070 | 0.032 | 0.038 | 0.5 | 0.07 | 0.8 |
| 3 | 0.033 | 0.031 | 0.036 | 0.9 | 0.03 | 0.9 |
| 4 | 0.053 | 0.035 | 0.039 | 0.7 | 0.05 | 0.9 |
| 5 | 0.155 | 0.039 | 0.046 | 0.3 | 0.16 | 0.8 |
| 6 | 0.008 | 0.008 | 0.008 | 1.0 | 0.01 | 1.0 |
| 7 | 0.062 | 0.057 | 0.063 | 0.9 | 0.06 | 0.9 |
| 8 | 0.068 | 0.060 | 0.070 | 0.9 | 0.07 | 0.9 |
| 9 | 0.072 | 0.018 | 0.020 | 0.3 | 0.07 | 0.9 |
| 10 | 0.077 | 0.012 | 0.014 | 0.2 | 0.08 | 0.9 |
| 11 | 0.070 | 0.029 | 0.032 | 0.4 | 0.07 | 0.9 |
| 12 | 0.068 | 0.033 | 0.042 | 0.5 | 0.07 | 0.8 |
| 13 | 0.064 | 0.035 | 0.050 | 0.5 | 0.06 | 0.7 |
| 14 | 0.064 | 0.036 | 0.058 | 0.6 | 0.06 | 0.6 |
| 15 | 0.084 | 0.072 | 0.077 | 0.9 | 0.08 | 0.9 |
| 16 | 0.084 | 0.056 | 0.068 | 0.7 | 0.08 | 0.8 |
| 17 | 0.085 | 0.041 | 0.053 | 0.5 | 0.09 | 0.8 |
| 18 | 0.085 | 0.033 | 0.046 | 0.4 | 0.09 | 0.7 |
| 19 | 0.085 | 0.028 | 0.038 | 0.3 | 0.09 | 0.7 |
| 20 | 0.145 | 0.038 | 0.051 | 0.3 | 0.15 | 0.7 |
| 21 | 0.163 | 0.045 | 0.061 | 0.3 | 0.16 | 0.7 |
| 22 | 0.245 | 0.050 | 0.068 | 0.2 | 0.25 | 0.7 |
| 23 | 0.390 | 0.070 | 0.115 | 0.2 | 0.39 | 0.6 |
| 24 | 0.420 | 0.077 | 0.142 | 0.2 | 0.42 | 0.5 |
| 25 | 0.090 | 0.014 | 0.080 | 0.2 | 0.09 | 0.2 |
| 26 | 0.285 | — | — | — | 0.29 | — |
| 27 | 0.261 | 0.015 | 0.072 | 0.1 | 0.26 | 0.2 |

In Table 4, a unit of Sc, S1 and S2 is $\mu m^2$.

Toner 2 Production Example

Production Example for High Molecular Weight Amorphous Polyester Resin (H) Fine Particle Dispersion (1)

The high molecular weight amorphous polyester resin (H)-1 (100 mass parts) was dissolved in 150 mass parts of tetrahydrofuran. While this tetrahydrofuran solution was being stirred for 2 minutes at room temperature at 10,000 rpm using a homogenizer (Ultra-Turrax, IKA Japan K.K.), 1,000 mass parts of deionized water containing 5 mass parts of potassium hydroxide and 10 mass parts of sodium dodecylbenzenesulfonate as surfactant was added dropwise. The tetrahydrofuran was then removed by heating the resulting mixed solution to approximately 75° C. This was followed by dilution with deionized water to a solids fraction of 8% to obtain a high molecular weight amorphous polyester resin (H) fine particle dispersion (1) having a volume-average particle diameter of 0.09 μm.

Production Example for Low Molecular Weight Amorphous Polyester Resin (L) Fine Particle Dispersion (1)

A low molecular weight amorphous polyester resin (L) fine particle dispersion (1) was obtained proceeding as in the aforementioned Production Example for High Molecular Weight Amorphous Polyester Resin (H) Fine Particle Dispersion (1), but changing the high molecular weight amorphous polyester resin (H)-1 to the low molecular weight amorphous polyester resin (L)-1.

Resin Composition Particle Dispersion (1) Production Example 100 mass parts of the resin composition 1, 1,000 mass parts of deionized water, and 5 mass parts of potassium hydroxide and 10 mass parts of sodium dodecylbenzenesulfonate as surfactant were introduced into a mixing vessel fitted with a stirring apparatus and were heated to 100° C. While circulating to a Clearmix W-Motion (M Technique Co., Ltd.), stirring was carried out under conditions of a rotor rotation rate of 20,000 rpm/min and a screen rotation rate of 20,000 rpm/min at a shear stirring position having a rotor outer diameter of 3 cm and a clearance of 0.3 mm. After a dispersion treatment for 60 minutes, a resin composition fine particle dispersion (1) having a volume-average particle diameter of 0.08 μm was obtained by cooling to 40° C. using cooling treatment conditions of a rotor rotation rate of 1,000 rpm/min, a screen rotation rate of 0 rpm/min, and a cooling rate of 10° C./min.

Colorant Fine Particle Dispersion Production Example

| | |
|---|---|
| colorant (cyan pigment:Pigment Blue 15:3) | 10 mass parts |
| anionic surfactant (Neogen RK, DKS Co., Ltd.) | 1.5 mass parts |
| deionized water | 88.5 mass parts |

These were mixed and dissolved, and dispersion was performed for 60 minutes using a Nanomizer high-pressure impact-type disperser (Yoshida Kikai Co., Ltd.) to prepare an aqueous dispersion of colorant fine particles having a volume-average particle diameter of 0.20 μm in which the colorant was dispersed.

Release Agent Fine Particle Dispersion Production Example

| | |
|---|---|
| Fischer-Tropsch wax (peak temperature of maximum endothermic peak = 90° C.) | 5.0 mass parts |
| anionic surfactant (Neogen RK, DKS Co., Ltd.) | 1.0 mass part |
| deionized water | 89 mass parts |

These were introduced into a mixing vessel equipped with a stirring device and were then heated to 90° C. While circulating to a Clearmix W-Motion (M Technique Co., Ltd.), stirring was carried out under conditions of a rotor rotation rate of 19,000 rpm/min and a screen rotation rate of 19,000 rpm/min at a shear stirring position having a rotor outer diameter of 3 cm and a clearance of 0.3 mm. After a dispersion treatment for 60 minutes, an aqueous dispersion of release agent fine particles having a volume-average particle diameter of 0.15 μm was obtained by cooling to 40° C. using cooling treatment conditions of a rotor rotation rate of 1,000 rpm/min, a screen rotation rate of 0 rpm/min, and a cooling rate of 10° C./min.

Toner Particle 2 Production Example

| | |
|---|---|
| low molecular weight amorphous polyester resin (L) fine particle dispersion (1) | 70.0 mass parts (amount corresponding to resin) |
| high molecular weight amorphous polyester resin (H) fine particle dispersion (1) | 30.0 mass parts (amount corresponding to resin) |

-continued

| | |
|---|---|
| resin composition fine particle dispersion (1) | 12.0 mass parts (amount corresponding to resin) |
| release agent fine particle dispersion | 5.0 mass parts (amount corresponding to release agent) |
| colorant fine particle dispersion | 5.0 mass parts (amount corresponding to colorant) |
| 1.5 mass % aqueous magnesium sulfate solution | 10 mass parts |

The preceding were dispersed using a homogenizer (Ultra-Turrax T50, IKA Japan K.K.). The pH was then adjusted to 8.1 using a 0.1 mol/L aqueous sodium hydroxide solution. This was followed by heating to 45° C. on a heating water bath while stirring with a stirring blade. After holding for 1.5 hours at 45° C., the formation of aggregate particles having an average particle diameter of approximately 5.7 μm was confirmed by observation with an optical microscope. After the addition of 40 mass parts of a 5 mass % aqueous trisodium citrate solution, core particle fusion was induced by raising the temperature to 85° C. while continuing to stir and holding for 90 minutes. Then, while continuing to stir, cooling to 25° C. was carried out by introducing water into the water bath. The volume-based median diameter was 5.6 μm when the particle diameter of the core particles was measured using a particle size distribution analyzer based on the Coulter principle (Coulter Multisizer III, Beckman Coulter, Inc.).

Then, after filtration/solid-liquid separation, the solid fraction was added to 800 mass parts of deionized water that had been adjusted to pH 8 with sodium hydroxide and stirring and washing was performed for 30 minutes. Filtration/solid-liquid separation were then carried out again. The solid fraction was subsequently added to 800 mass parts of deionized water and stirring and washing was performed for 30 minutes. This was followed by carrying out filtration/solid-liquid separation again, and this was performed five times. A toner particle 2 was obtained by drying the obtained solid fraction.

1.0 mass part of silica fine particles having an average primary particle diameter of 15.0 nm was added to 100 mass parts of the obtained toner particle 2; mixing was carried out for 5 minutes at a rotation rate of 31.6 $s^{-1}$ using a Henschel mixer (Model FM75J, Mitsui Miike Chemical Engineering Machinery Co., Ltd.); and passage through an ultrasound vibrating screen with an aperture of 54 μm yielded a toner 2.

Two-Component Developer 2 Production Example

Using a V-mixer (Model V-10, Tokuju Kosakusho Co., Ltd.), a two-component developer 2 was obtained by mixing the toner 2 with silicone resin-surface-coated magnetic ferrite carrier particles (number-average particle diameter=35 μm) at 0.5 $s^{-1}$ for 5 minutes so as to yield a toner concentration of 9 mass %.

The same evaluations as in Example 1 were carried out. The measurement results for the toner are given in Table 4, and the evaluation results for the developer are given in Table 5.

[Image Evaluations]

An imagePRESS C800 full-color copier from Canon Inc. was used as the image-forming apparatus.

A 20,000-print (A4 paper) image output durability test was run in a high-temperature, high-humidity environment (30° C./80% RH, also indicated in the following as the "H/H environment"). Moreover, during the 20,000-print continuous paper feed, paper feed is carried out at the same developing conditions and transfer conditions (no calibration) as for the first print. With regard to the image durability testing, the image had a print percentage of 5% and the development bias was adjusted to provide an initial image density of 1.45. CS-680 plain copy paper (A4, areal weight=68 g/$m^2$, commercially available from Canon Marketing Japan Inc.) was used in the durability tests and evaluations.

Performance evaluations of the toners were performed according to the following methods.

<Evaluation of the Image Density after Initial Holding in the H/H Environment>

100 prints of a solid image over the entire surface of the A4 paper were output in the H/H environment followed by holding for 7 days in the same environment and then the output of 1 print of a solid image over the entire surface of the A4 paper. The image on the 100th print output prior to holding and the image output after holding were used for the evaluation. The density was measured using a 500 series spectrodensitometer (X-Rite Inc.) and the average value for 5 points was used for the image density; the image density prior to holding was compared with the image density after holding and this was scored according to the following scale. For the present invention, C or better was judged to be excellent.

(Evaluation Criteria)

A: the percentage change for the image density post-holding is less than 4%

B: the percentage change for the image density post-holding is at least 4% and less than 8%

C: the percentage change for the image density post-holding is at least 8% and less than 12%

D: the percentage change for the image density post-holding is at least 12% and less than 16%

E: the percentage change for the image density post-holding is at least 16%

<Evaluation of Image Density Durability>

The evaluation of the image density after the initial holding was followed by a 20,000-print continuous paper feed durability test. For the evaluation of the image density durability, the 20,000-print image output durability test was run in the H/H environment; 100 prints were then output of a solid image over the entire surface of A4 paper (CS-680 plain copy paper, A4); and the image on the 100th print was used for the evaluation. The density was measured using a 500 series spectrodensitometer (X-Rite Inc.) and the average value for 5 points was used for the image density. A comparison was made with the density of the initial image (solid image on the 100th print output prior to the initial holding) with scoring using the scale given below. For the present invention, C or better was judged to be excellent.

(Evaluation Criteria)

A: the image density retention percentage after the durability test is at least 90%

B: the image density retention percentage after the durability test is at least 80% and less than 90%

C: the image density retention percentage after the durability test is at least 70% and less than 80%

D: the image density retention percentage after the durability test is at least 60% and less than 70%

E: the image density retention percentage after the durability test is less than 60%

<Evaluation of Fogging>

For the evaluation of fogging, the 20,000-print image output durability test was run in the H/H environment followed by printing a solid white image over the entire surface of A3 paper and scoring according to the criteria given below. The average reflectance Dr (%) for 6 points on the unprinted paper and the average reflectance Ds (%) for 6 points on the printed paper were measured using a reflectometer ("Reflectometer Model TC-6DS" from Tokyo Denshoku Co., Ltd.) and the fogging percentage (%) was determined. In the present invention, C or better was judged to be excellent.

$$\text{fogging percentage (\%)} = Dr(\%) - Ds(\%)$$

A: the fogging percentage is less than 0.5%
B: the fogging percentage is at least 0.5% and less than 1.0%
C: the fogging percentage is at least 1.0% and less than 2.0%
D: the fogging percentage is at least 2.0% and less than 3.0%
E: the fogging percentage is at least 3.0%

<Evaluation of Image Density after Holding in the H/H Environment after a Durability Test>

After the 20,000-print image output durability test in the H/H environment, holding for 7 days was carried in the same environment; one print of a solid image over the entire surface of A4 paper was then output; and this image was used for the evaluation. The density was measured using a 500 series spectrodensitometer (X-Rite Inc.) and the average value for 5 points was used for the image density. A comparison was made with the density of the image immediately after the durability test (solid image on the 100th print output after the durability test) with scoring using the scale given below. In the present invention, C or better was judged to be excellent.

(Evaluation Criteria)

A: the percentage change for the image density post-holding is less than 5%
B: the percentage change for the image density post-holding is at least 5% and less than 10%
C: the percentage change for the image density post-holding is at least 10% and less than 15%
D: the percentage change for the image density post-holding is at least 15% and less than 20%
E: the percentage change for the image density post-holding is at least 20%

<Evaluation of Image Uniformity>

For the evaluation of the image uniformity, after the 20,000-print continuous paper feed, 3 prints of a halftone image over the entire surface of A3 paper were output and the image on the 3rd print was used for the evaluation. To evaluate the image uniformity, the image density was measured at 5 locations and the difference between the maximum value and the minimum value was determined. With regard to the image density, the density was measured using a 500 series spectrodensitometer (X-Rite Inc.) and scoring was done using the following criteria. In the present invention, C or better was judged to be excellent.

A: the density difference in the halftone region is less than 0.04
B: the density difference in the halftone region is at least 0.04 and less than 0.08
C: the density difference in the halftone region is at least 0.08 and less than 0.12
D: the density difference in the halftone region is at least 0.12 and less than 0.16
E: the density difference in the halftone region is at least 0.16

<Evaluation of the Bending Resistance>

The resistance to bending by the image was evaluated in a normal-temperature, normal-humidity environment (23° C./50% RH, also indicated in the following as the "N/N environment"). The developing voltage was initially adjusted to provide a toner laid-on level for an FFh image of 0.45 mg/cm$^2$, and an FFh image with a size of 10 cm×10 cm was output. The fixed image was then bent into a cross and was rubbed in 5 back-and-forth excursions with a soft, thin paper (for example, product name: "Dusper", Ozu Corporation) that was being loaded with a load of 4.9 kPa. When the toner exfoliates in the cross region, a sample is obtained in which the paper background can be seen. Then, using a CCD camera, the cross portion is photographed over a 512-pixel-square region at a resolution of 800 pixels/inch. The image is binarized with the threshold set to 60% and a region where the toner has exfoliated is then a white region: a smaller white region area percentage indicates a better resistance to bending. In the present invention, C or better was judged to be excellent.

The following paper was used in the evaluation of the resistance to bending.

paper: GF-C157 high-whiteness paper (157 g/m$^2$)
(commercially available from Canon Marketing Japan Inc.)

(Evaluation Criteria)

A: the white region area percentage is less than 1.0%
B: the white region area percentage is at least 1.0% and less than 3.0%
C: the white region area percentage is at least 3.0% and less than 5.0%
D: the white region area percentage is at least 5.0% and less than 7.0%
E: the white region area percentage is at least 7.0%

TABLE 5

| | image density pre-versus-post-initial holding, H/H | | image density pre-versus-post-durability testing, H/H | | fogging after durability test, H/H | | image density pre-versus-post-standing after a durability test, H/H | | image uniformity after durability test, H/H | | evaluation of resistance to bending white region area | |
|---|---|---|---|---|---|---|---|---|---|---|---|---|
| Example No. | evaluation | density percentage change (%) | evaluation | density retention percentage (%) | evaluation | fogging (%) | evaluation | density percentage change (%) | evaluation | density difference | evaluation | white region area percentage (%) |
| 1 | A | 2 | A | 93 | A | 0.2 | A | 3 | A | 0.02 | A | 0.4 |
| 2 | A | 2 | A | 94 | A | 0.2 | A | 2 | A | 0.02 | A | 0.4 |
| 3 | A | 1 | A | 96 | A | 0.1 | A | 2 | A | 0.01 | A | 0.5 |

TABLE 5-continued

| | image density pre-versus-post-initial holding, H/H | | image density pre-versus-post-durability testing, H/H | | fogging after durability test, H/H | | image density pre-versus-post-standing after a durability test, H/H | | image uniformity after durability test, H/H | | evaluation of resistance to bending white region area | |
|---|---|---|---|---|---|---|---|---|---|---|---|---|
| Example No. | evaluation | density percentage change (%) | evaluation | density retention percentage (%) | evaluation | fogging (%) | evaluation | density percentage change (%) | evaluation | density difference | evaluation | percentage (%) |
| 4 | A | 1 | A | 95 | A | 0.1 | A | 2 | A | 0.01 | A | 0.4 |
| 5 | B | 6 | B | 89 | B | 0.9 | B | 8 | B | 0.05 | A | 0.4 |
| 6 | A | 1 | A | 94 | A | 0.1 | A | 2 | A | 0.01 | B | 1.5 |
| 7 | A | 1 | A | 93 | A | 0.2 | A | 2 | A | 0.01 | A | 0.4 |
| 8 | A | 1 | A | 92 | A | 0.2 | A | 3 | A | 0.02 | A | 0.4 |
| 9 | A | 3 | B | 86 | B | 0.5 | B | 5 | A | 0.02 | A | 0.3 |
| 10 | B | 7 | B | 82 | B | 0.8 | C | 10 | B | 0.07 | A | 0.3 |
| 11 | B | 6 | B | 87 | B | 0.5 | B | 5 | A | 0.02 | A | 0.3 |
| 12 | B | 4 | B | 85 | B | 0.6 | B | 5 | B | 0.04 | A | 0.3 |
| 13 | B | 4 | B | 81 | C | 1.0 | B | 6 | B | 0.06 | A | 0.3 |
| 14 | B | 4 | C | 79 | C | 1.1 | B | 6 | C | 0.08 | A | 0.3 |
| 15 | A | 1 | A | 91 | A | 0.3 | A | 3 | A | 0.03 | B | 1.3 |
| 16 | A | 1 | A | 91 | A | 0.3 | A | 3 | A | 0.03 | B | 1.3 |
| 17 | A | 3 | A | 90 | A | 0.4 | A | 3 | B | 0.05 | B | 1.3 |
| 18 | A | 3 | B | 87 | A | 0.4 | A | 4 | C | 0.08 | B | 1.2 |
| 19 | B | 4 | B | 86 | B | 0.5 | B | 5 | C | 0.09 | B | 1.2 |
| 20 | B | 5 | B | 84 | B | 0.7 | B | 6 | C | 0.10 | B | 1.8 |
| 21 | B | 7 | B | 83 | B | 0.9 | B | 7 | C | 0.10 | B | 2.4 |
| 22 | C | 9 | B | 80 | C | 1.1 | B | 8 | C | 0.11 | C | 3.0 |
| 23 | C | 10 | C | 79 | C | 1.4 | C | 10 | C | 0.11 | C | 3.3 |
| 24 | C | 11 | C | 77 | C | 1.8 | C | 12 | C | 0.11 | C | 3.4 |
| 25 | C | 11 | C | 70 | C | 1.3 | C | 11 | C | 0.11 | C | 4.9 |
| Comparative 1 | E | 23 | D | 64 | D | 2.9 | C | 13 | D | 0.15 | A | 0.9 |
| Comparative 2 | D | 15 | D | 68 | C | 1.9 | C | 12 | D | 0.14 | C | 4.5 |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-090033, filed Apr. 28, 2016, which is hereby incorporated by reference herein in its entirety.

What is claimed is:

1. A toner comprising a toner particle comprising a binder resin, a wax and inorganic fine particles, the binder resin comprising a crystalline polyester resin and an amorphous polyester resin, wherein the content of the inorganic fine particles in the toner particle is 0.5 to 5.0 mass parts per 100 mass parts of the binder resin, and in a cross section of the toner particle, $S1/Sc \geq 0.3$ when Sc represents an area taken up by the crystalline polyester resin and S1 represents an area taken up by the inorganic fine particles that are present in the crystalline polyester resin portion.

2. The toner according to claim 1, wherein in a cross section of the toner particle, $0.01 \leq Sc/St \leq 0.40$ when St represents a cross-sectional area of the toner particle, and in a cross section of the toner particle, $S1/S2 \geq 0.6$ when S2 represents a total area taken up by the inorganic fine particles.

3. The toner according to claim 1, wherein the number-average particle diameter (D1) of primary particles of the inorganic fine particles in the toner particle is 6 to 300 nm.

4. The toner according to claim 1, wherein the inorganic fine particles are silica particles or alumina particles.

5. A method of producing a toner comprising a toner particle comprising a binder resin, a wax and inorganic fine particles, the binder resin comprising a crystalline polyester resin and an amorphous polyester resin, the method comprising the steps of:

obtaining a resin composition by dispersing the inorganic fine particles in the melted crystalline polyester resin;

dispersing fine particles of the resin composition, fine particles of the amorphous polyester resin, and fine particles of the wax;

forming an aggregate particle containing the fine particles of the resin composition, the fine particles of the amorphous polyester resin, and the fine particles of the wax; and inducing fusion of the aggregate particle, wherein the content of the inorganic fine particles in the toner particle is 0.5 to 5.0 mass parts per 100 mass parts of the binder resin, and in a cross section of the toner particle, $S1/Sc \geq 0.3$ when Sc represents an area taken up by the crystalline polyester resin and Si represents an area taken up by the inorganic fine particles that are present in the crystalline polyester resin portion.

6. A method of producing a toner comprising a toner particle comprising a binder resin, a wax and inorganic fine particles, the binder resin comprising a crystalline polyester resin and an amorphous polyester resin, the method comprising the steps of:

obtaining a resin composition by dispersing the inorganic fine particles in the melted crystalline polyester resin;

obtaining a kneaded material by melt-kneading a mixture containing the resin composition, the amorphous polyester resin, and the wax; and cooling and pulverizing the kneaded material, wherein the content of the inorganic fine particles in the toner particle is 0.5 to 5.0 mass parts per 100 mass parts of the binder resin, and in a cross section of the toner particle, $S1/Sc \geq 0.3$ when Sc represents an area taken up by the crystalline polyester resin and Si represents an area taken up by the inorganic fine particles that are present in the crystalline polyester resin portion.

7. The toner according to claim 1, wherein the content of the crystalline polyester resin in the toner particle is 1 to 40 mass parts per 100 mass parts of the amorphous polyester resin.

* * * * *